US009755312B2

(12) United States Patent
Yoshikawa

(10) Patent No.: US 9,755,312 B2
(45) Date of Patent: Sep. 5, 2017

(54) ANTENNA DEVICE AND MANUFACTURING METHOD FOR ANTENNA DEVICE

(71) Applicant: Panasonic Corporation, Kadoma-shi, Osaka (JP)

(72) Inventor: Yoshishige Yoshikawa, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 517 days.

(21) Appl. No.: 14/382,249

(22) PCT Filed: Jan. 15, 2013

(86) PCT No.: PCT/JP2013/000133

§ 371 (c)(1),
(2) Date: Aug. 29, 2014

(87) PCT Pub. No.: WO2013/132732

PCT Pub. Date: Sep. 12, 2013

(65) Prior Publication Data

US 2015/0303578 A1 Oct. 22, 2015

(30) Foreign Application Priority Data

Mar. 9, 2012 (JP) ..... 2012-052764

(51) Int. Cl.
*H01Q 1/24* (2006.01)
*H01Q 9/12* (2006.01)
(Continued)

(52) U.S. Cl.
CPC ..... *H01Q 9/12* (2013.01); *H01Q 1/1264* (2013.01); *H01Q 1/24* (2013.01); *H01Q 3/06* (2013.01);
(Continued)

(58) Field of Classification Search
CPC .. H01Q 1/24; H01Q 9/12; H01Q 3/06; H01Q 9/16
(Continued)

(56) References Cited

U.S. PATENT DOCUMENTS 3,478,361 A * 11/1969 Middlemark ..... H01Q 1/24 343/730
3,988,737 A * 10/1976 Middlemark ..... H01Q 3/24 343/809
(Continued)

FOREIGN PATENT DOCUMENTS

JP 6-5206 U 1/1994
JP 8-293719 A 11/1996
(Continued)

OTHER PUBLICATIONS

International Search Report in corresponding International Application No. PCT/JP2013/000133, dated Apr. 23, 2013, 2 pages.

*Primary Examiner* — Huedung Mancuso
(74) *Attorney, Agent, or Firm* — Brinks Gilson & Lione

(57) ABSTRACT

The present application discloses antenna device including first and second antenna elements which communicate radio waves; housing which stores processor for processing signals in response to the radio waves; first and second element covers for storing first and second antenna elements, respectively. First element cover includes first rotary cylinder, which is held by housing and rotatable around first rotational axis, and first protruding cylinder, which protrudes from first rotary cylinder, first rotary cylinder protruding from housing along first rotational axis. Second element cover includes second rotary cylinder, which is held by housing and rotatable around second rotational axis, and second protruding cylinder, which protrudes from second rotary cylinder, second rotary cylinder protruding from housing along second rotational axis. First included angle between first and second
(Continued)

protruding cylinders storing first and second antenna elements is changed by rotation of at least one of first and second rotary cylinders.

12 Claims, 29 Drawing Sheets

(51) Int. Cl.

| | |
|---|---|
| ***H01Q 3/06*** | (2006.01) |
| ***H01Q 9/30*** | (2006.01) |
| ***H01Q 1/12*** | (2006.01) |
| ***H01Q 9/16*** | (2006.01) |
| *H01Q 1/22* | (2006.01) |

(52) U.S. Cl.
CPC ..... *H01Q 9/16* (2013.01); *H01Q 9/30* (2013.01); *H01Q 1/2275* (2013.01)

(58) Field of Classification Search
USPC ..... 343/702
See application file for complete search history.

(56) References Cited

U.S. PATENT DOCUMENTS

| | | | | |
|---|---|---|---|---|
| 4,293,861 | A * | 10/1981 | Winegard | H01Q 1/24 343/766 |
| 5,528,251 | A * | 6/1996 | Frein | H01Q 9/16 343/749 |
| 5,771,015 | A * | 6/1998 | Kirtman | H01Q 21/28 342/359 |
| 8,736,500 | B1 * | 5/2014 | Lam | H01P 5/10 343/726 |
| 2007/0273595 | A1 | 11/2007 | Shimasaki et al. | |
| 2009/0073060 | A1 | 3/2009 | Shimasaki et al. | |
| 2010/0309083 | A1 | 12/2010 | Su | |
| 2012/0075164 | A1 | 3/2012 | Shimasaki et al. | |

FOREIGN PATENT DOCUMENTS

| | | | |
|---|---|---|---|
| JP | 10-209905 | A | 8/1998 |
| JP | 2002-330013 | A | 11/2002 |
| JP | 2005-039539 | A | 2/2005 |
| JP | 2005-184713 | A | 7/2005 |
| JP | 2007-318678 | A | 12/2007 |
| JP | 2009-141837 | A | 6/2009 |

* cited by examiner

ANTENNA DEVICE AND MANUFACTURING METHOD FOR ANTENNA DEVICE

This application is a 371 application of PCT/JP2013/000133 having an international filing date of Jan. 15, 2013, which claims priority to JP2012-052764 filed Mar. 9, 2012, the entire contents of which are incorporated herein by reference.

TECHNICAL FIELD

The present invention relates to an antenna device configured to transmit and receive radio waves and a method for manufacturing the antenna device.

BACKGROUND ART

Radio communication technologies have been used in various devices in recent years. Some of the devices receive radio waves by using a plurality of antenna elements (c.f. Patent Documents 1 to 3).

An actuator provided with the antenna element may execute operations corresponding to the received radio waves. Consequently, the antenna element may be suitably used in remote control of the actuator.

An antenna device, which processes signals in response to radio wave received by the antenna element and outputs control signals for controlling an operation of the actuator, is attached to or detached from the actuator if necessary. Therefore, the antenna device may be used in various technical fields.

As described above, if the antenna device is externally attached to the actuator, the antenna device may be placed in a limited place, depending on an installation position of the actuator. As the result of the placement of the antenna device in the limited place, an improvement in communication quality on the basis of diversity technologies, particularly polarization diversity, may be severely limited.

Patent Document 1: JP 2005-184713 A

Patent Document 2: JP 2007-318678 A

Patent Document 3: JP 2005-39539 A

SUMMARY OF THE INVENTION

An object of the present invention is to provide an antenna device configured to achieve good quality communication and a method for manufacturing the antenna device.

An antenna device according to one aspect of the present invention includes a first antenna element and a second antenna element which transmit and receive a radio wave, a housing which stores a processor for processing a signal in response to the radio wave, a first element cover configured to store the first antenna element, and a second element cover configured to store the second antenna element. The first element cover includes a first rotary cylinder, which is held by the housing and rotatable around a first rotational axis, and a first protruding cylinder, which protrudes from the first rotary cylinder, the first rotary cylinder protruding from the housing along the first rotational axis. The second element cover includes a second rotary cylinder, which is held by the housing and rotatable around a second rotational axis, and a second protruding cylinder, which protrudes from the second rotary cylinder, the second rotary cylinder protruding from the housing along the second rotational axis. A first included angle defined between the first protruding cylinder, which stores the first antenna element, and the second protruding cylinder, which stores the second antenna element, is changed by rotation of at least one of the first and second rotary cylinders.

A method for manufacturing the antenna device according to another aspect of the present invention includes steps of inserting the first and second rotary cylinders into through holes to incorporate a first case, a first element cover and a second element cover, fitting a first holder in a first annular groove and a second holder in a second annular groove, rotating the first and second rotary cylinders to place the first holder between the first rotary cylinder and the first case and the second holder between the second rotary cylinder and the first case and expose the first and second annular grooves, fitting a main holder in the exposed first and second annular grooves, and overlapping the second case with the first case.

The aforementioned antenna device may achieve good quality communication. The antenna device is easily assembled on the basis of the aforementioned manufacturing method.

Objects, features, and advantages of the present invention will become more apparent from the following detailed description and the accompanying drawings.

DETAILED DESCRIPTION OF THE INVENTION

Figure 1:
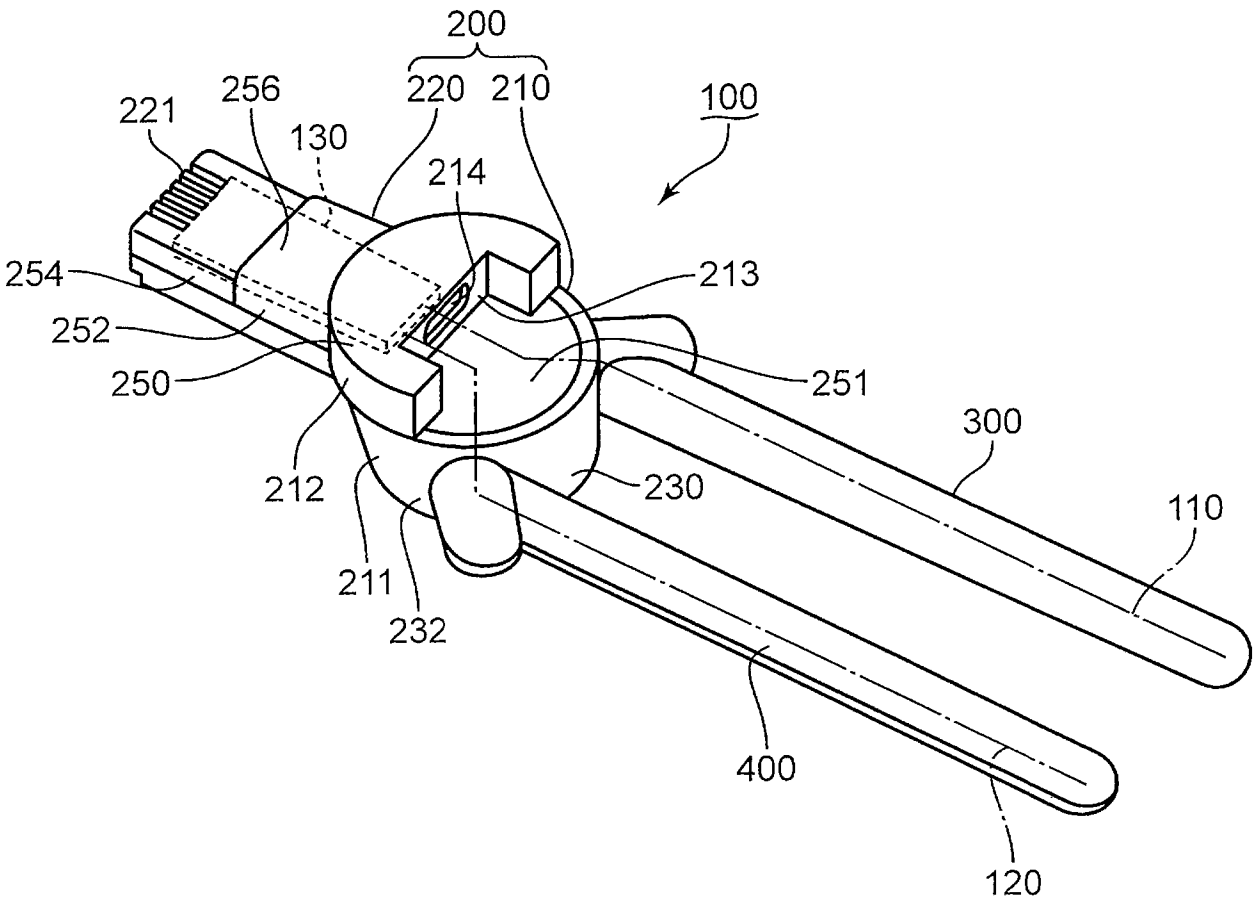
FIG. 1 is a schematic perspective view of an antenna device.

An antenna device and a method for manufacturing the antenna device are described with reference to the drawings. In the following embodiment, similar components are designated by similar reference numerals. In order to clarify the description, redundant description is omitted as appropriate. Configurations, arrangements and shapes shown in the drawings and descriptions about the drawings are only for making principles of the present embodiment easily understood. The principles of the antenna device and the manufacturing method for the antenna device are not limited to them.

<Antenna Device>

Figure 2:
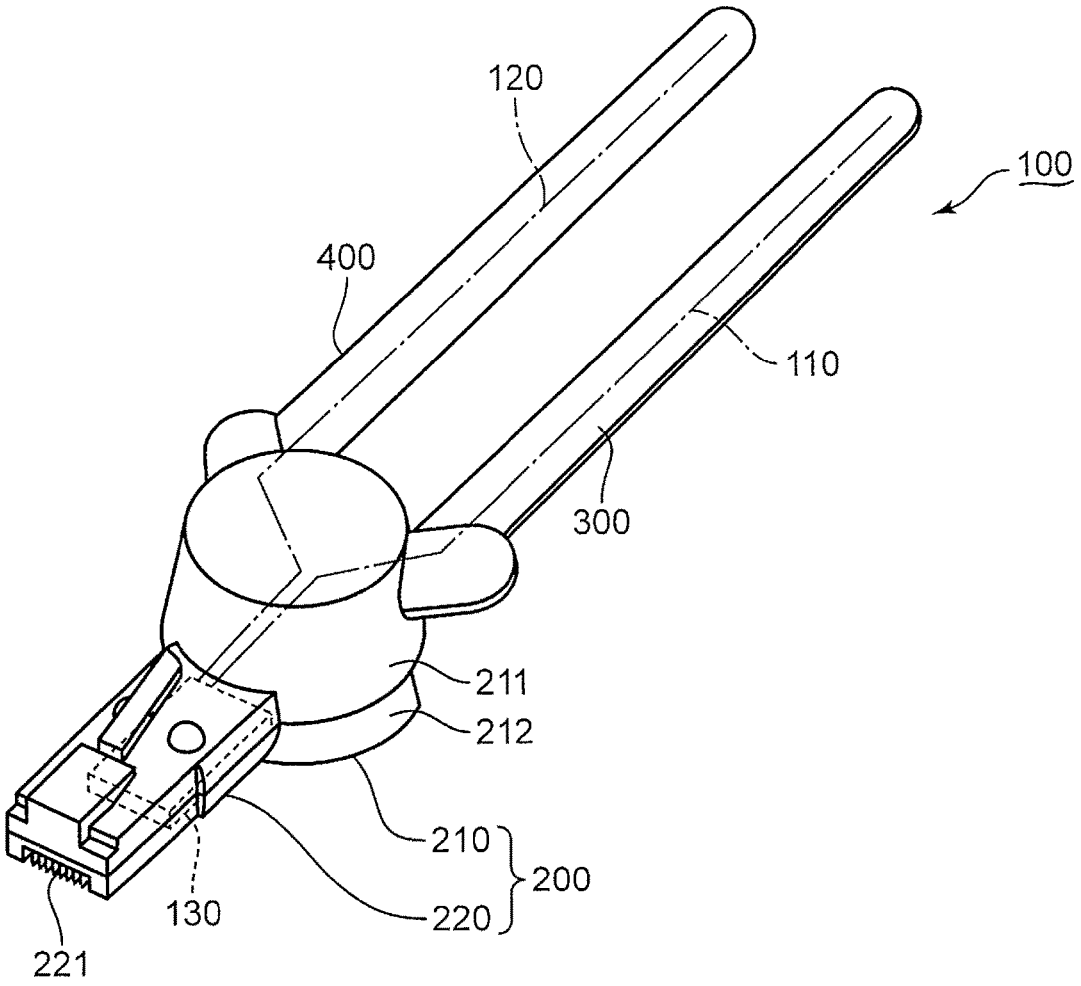
FIG. 2 is a schematic perspective view of the antenna device shown in FIG. 1.

FIGS. 1 and 2 are schematic perspective views of an antenna device 100. The antenna device 100 is described with reference to FIGS. 1 and 2.

The antenna device 100 includes a first antenna element 110 and a second antenna element 120, which transmit and receive radio waves, and a radio circuit 130 including a reception circuit and a transmission circuit. The radio circuit 130 processes signals in response to the radio waves received by the first and second antenna elements 110, 120. In FIGS. 1 and 2, the first and second antenna elements 110, 120 are schematically shown by using the one-dot chain line. The radio circuit 130 is schematically shown by using the dotted line. In the present embodiment, the radio circuit 130 is exemplified as the processor.

The antenna device 100 further includes a housing 200, which stores the radio circuit 130, a first element cover 300, which stores the first antenna element 110 formed from a metal wire, and a second element cover 400, which stores the second antenna element 120 formed from a metal wire. The first and second element covers 300, 400 protrude from the housing 200. The housing 200, the first and second element covers 300, 400 are formed from resin.

The housing 200 includes a substantially disk-like first portion 210, which supports the first and second element covers 300, 400, and a substantially rectangular parallelepiped second portion 220, which protrudes in a direction opposite to the first and second element covers 300, 400.

As shown in FIG. 1, the first portion 210 includes a disk portion 211, from which the first and second element covers 300, 400 protrude, and a substantially C-shaped raised portion 212, which is raised from the disk portion 211. The raised portion 212 includes an upright wall 213 which stands from the disk portion 211. The upright wall 213 is formed with a USB slot 214 for supplying electric power to the antenna device 100. The radio circuit 130 processes signals in response to radio waves received by the first and second antenna elements 110, 120, and outputs processing signals. When an external device is connected via the USB slot 214, the external device may execute a predetermined operation in response to the processing signals.

A LAN terminal 221 is formed at the distal end of the second portion 220. The radio circuit 130 processes signals in response to radio waves received by the first and second antenna elements 110, 120, and outputs processing signals. An external device connected via the LAN terminal 221 may execute a predetermined operation in response to the processing signals.

Figure 3:
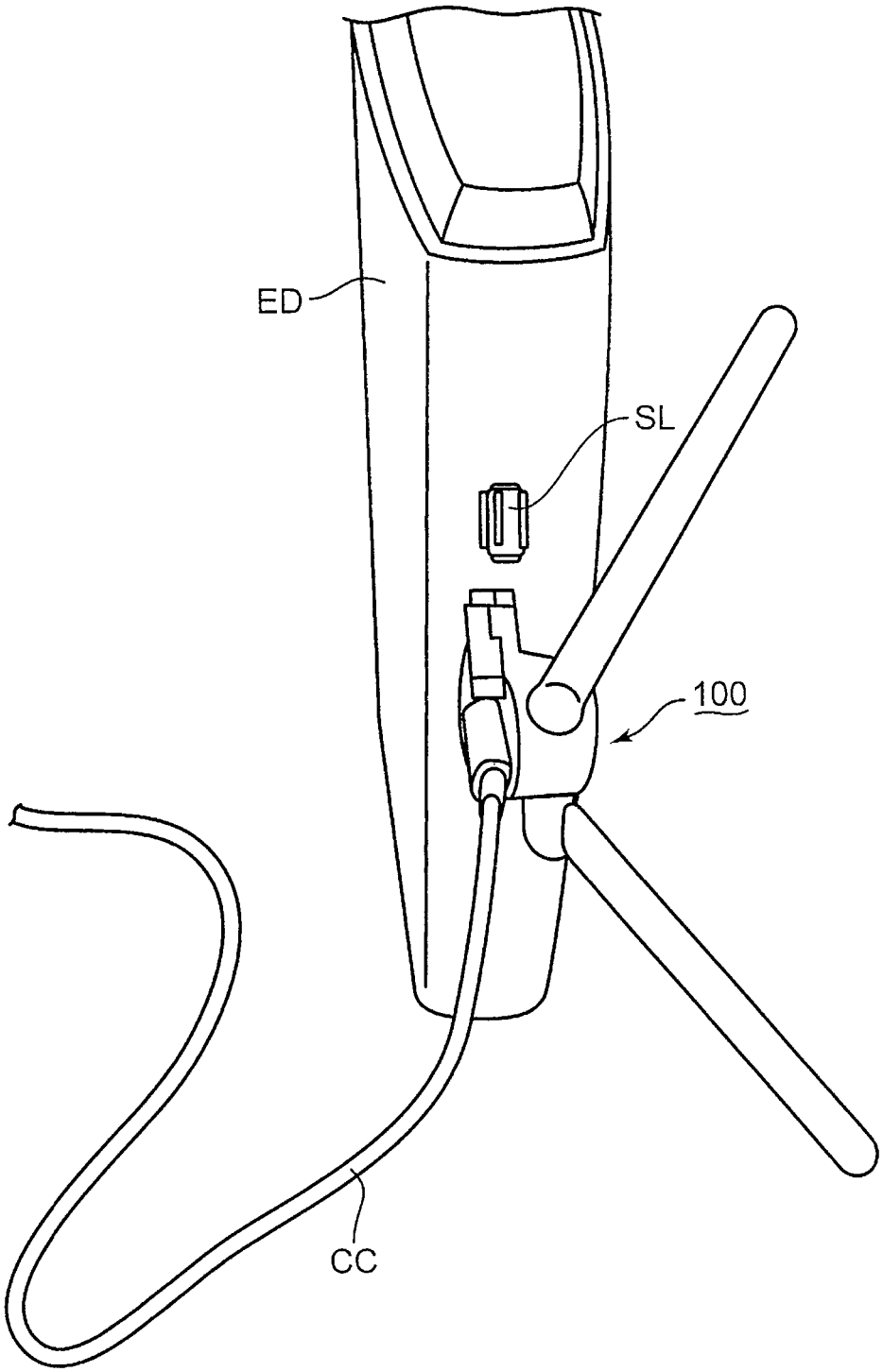
FIG. 3 is a schematic perspective view of the antenna device shown in FIG. 1.

FIG. 3 is a schematic perspective view of the antenna device 100 in use. The antenna device 100 is further described with reference to FIGS. 1 and 3.

The antenna device 100 is suitably used together with an external device ED having a LAN port PT corresponding to the LAN terminal 221. The second portion 220 is inserted into the LAN port PT of the external device ED. The external device ED may execute a predetermined operation in response to the processing signals output through the LAN terminal 221. The second portion 220 is pulled out from the LAN port PT if necessary. Consequently, the antenna device 100 is removed from the external device ED if necessary. In the present embodiment, the external device ED is exemplified as the actuator. The second portion 220 is exemplified as the connector.

A user may connect a connection cable CC to the USB slot 214 of the antenna device 100 if necessary. With the connection cable CC connected to the USB slot 214, the antenna device 100 is connected to an AC adaptor (not shown).

Figure 4:
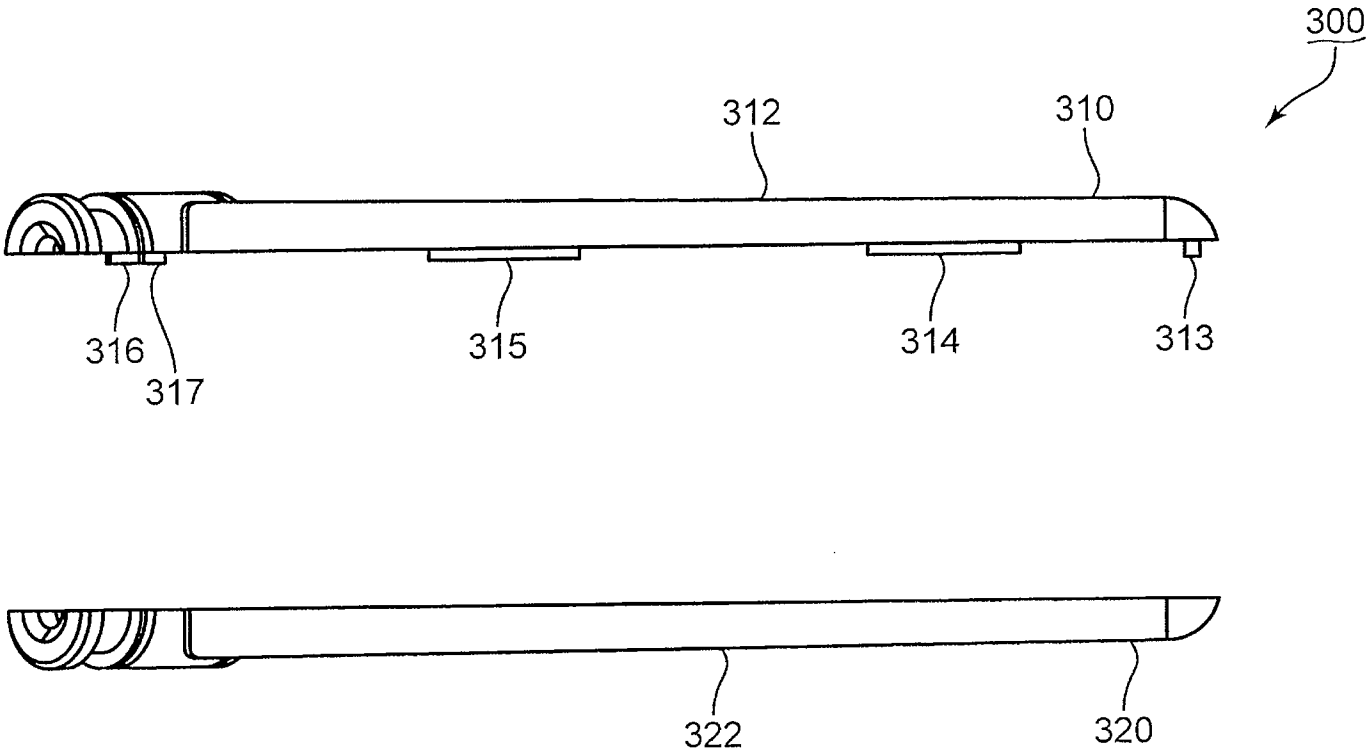
FIG. 4 is a schematic exploded view of a first element cover of the antenna device shown in FIG. 1.
Figure 5A:
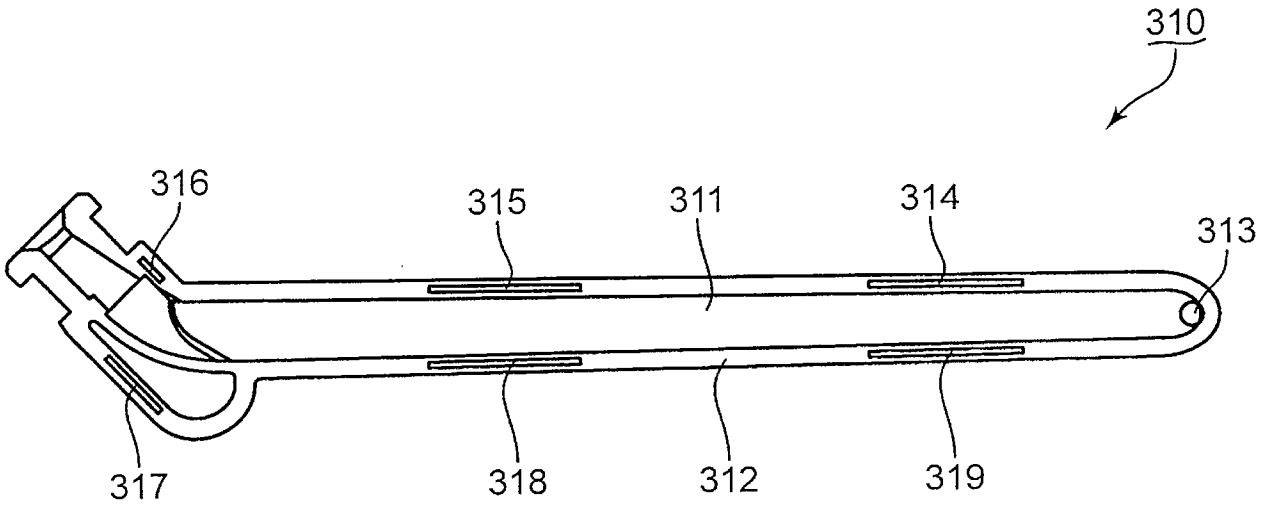
FIG. 5A is a schematic part drawing of the first element cover shown in FIG. 4.
Figure 5B:
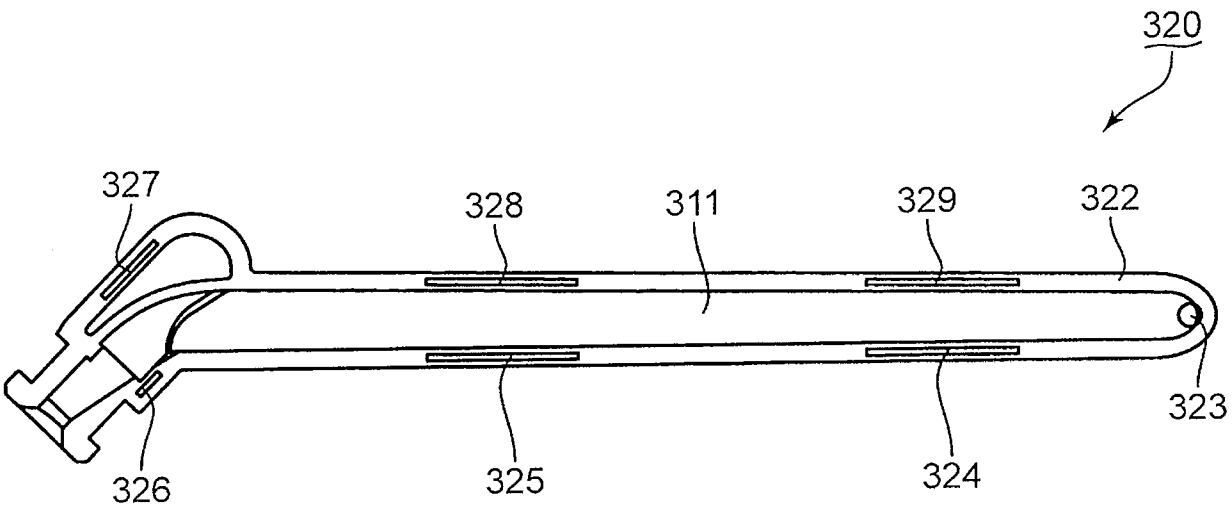
FIG. 5B is a schematic part drawing of the first element cover shown in FIG. 4.

FIG. 4 is a schematic exploded view of the first element cover 300. FIGS. 5A and 5B are schematic part drawings of the first element cover 300. The first element cover 300 is described with reference to FIGS. 1, 4 to 5B.

As shown in FIG. 4, the first element cover 300 is formed of a male semi-cylinder 310 and a female semi-cylinder 320 which is incorporated with the male semi-cylinder 310. FIG. 5A schematically shows the inner surface of the male semi-cylinder 310. FIG. 5B schematically shows the inner surface of the female semi-cylinder 320. The inner surface of the male semi-cylinder 310 is joined to the inner surface of the female semi-cylinder 320 to form the first element cover 300.

The male semi-cylinder 310 includes an outer wall 312 configured to form a hollow portion 311, into which the first antenna element 110 is inserted, and protrusions 313 to 319, which protrude toward the female semi-cylinder 320. The protrusions 313 to 319 are formed along the surface joined to the female semi-cylinder 320.

The female semi-cylinder 320 includes an outer wall 322 which collaborates with the male semi-cylinder 310 to form the hollow portion 311. The outer wall 322 is formed with fitting holes 323 to 329 in correspondence to the protrusions 313 to 319. The protrusions 313 to 319 are fitted in the fitting holes 323 to 329 to complete the first element cover 300.

Figure 6:
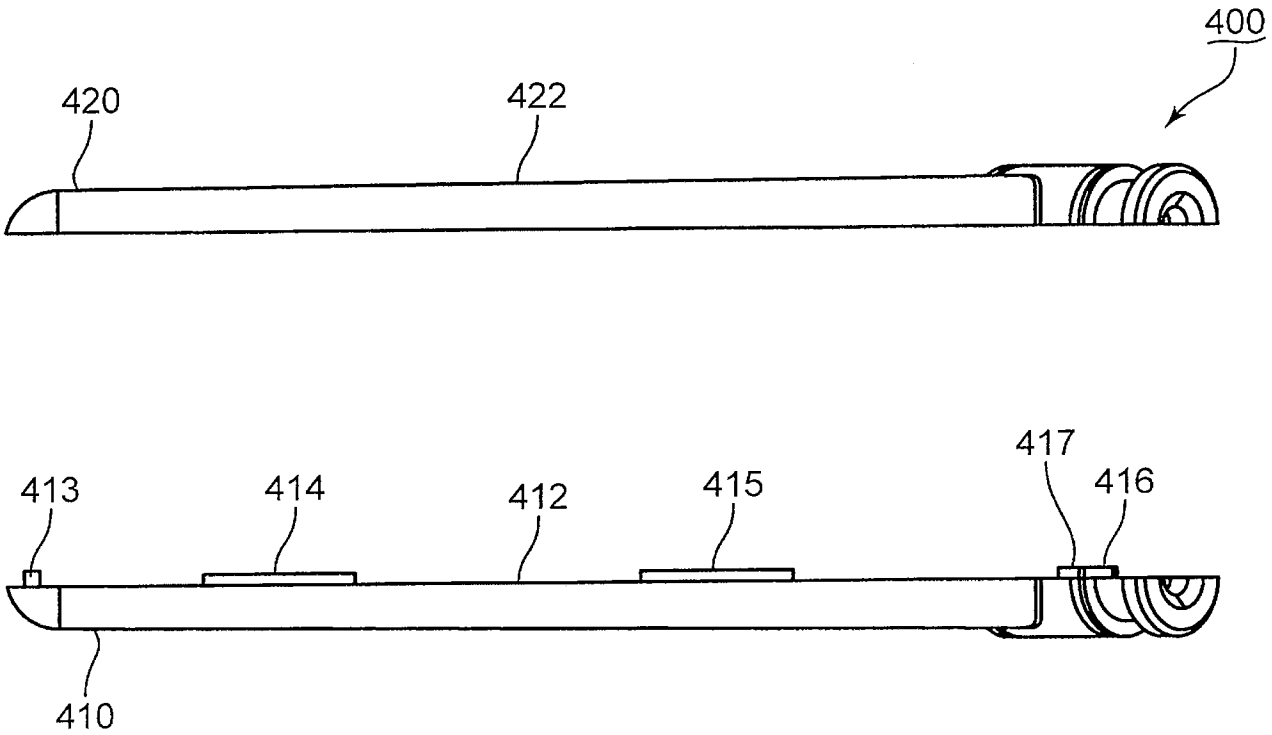
FIG. 6 is a schematic exploded view of a second element cover of the antenna device shown in FIG. 1.
Figure 7A:
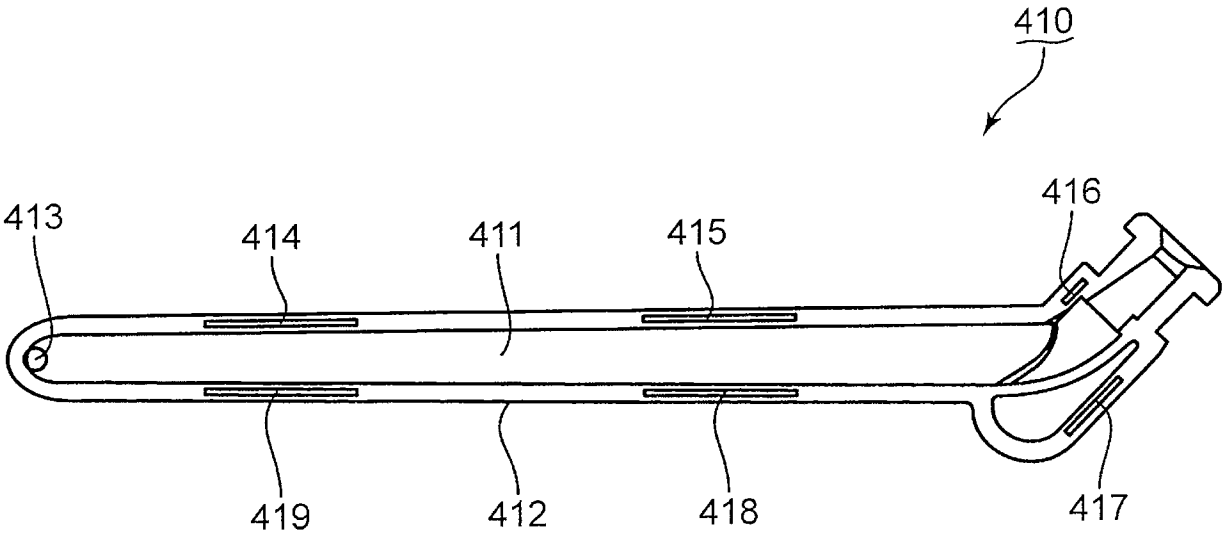
FIG. 7A is a schematic part drawing of the second element cover shown in FIG. 6.
Figure 7B:
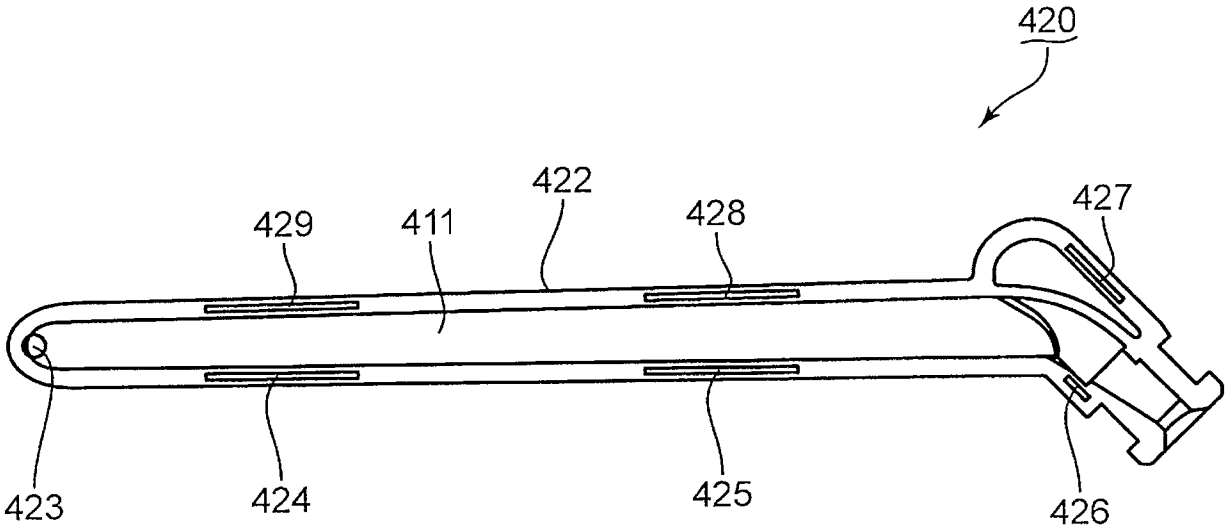
FIG. 7B is a schematic part drawing of the second element cover shown in FIG. 6.

FIG. 6 is a schematic exploded view of the second element cover 400. FIGS. 7A and 7B are schematic part drawings of the second element cover 400. The second element cover 400 is described with reference to FIGS. 1, 6 to 7B.

As shown in FIG. 6, the second element cover 400 is formed of a male semi-cylinder 410 and a female semi-cylinder 420 which is incorporated with the male semi-cylinder 410. FIG. 7A schematically shows the inner surface of the male semi-cylinder 410. FIG. 7B schematically shows the inner surface of the female semi-cylinder 420. The inner surface of the male semi-cylinder 410 is joined to the inner surface of the female semi-cylinder 420 to form the second element cover 400.

The male semi-cylinder 410 includes an outer wall 412 configured to form a hollow portion 411, into which the second antenna element 120 is inserted, and protrusions 413 to 419 which protrude toward the female semi-cylinder 420. The protrusions 413 to 419 are formed along the surface joined to the female semi-cylinder 420.

The female semi-cylinder 420 includes an outer wall 422 which collaborates with the male semi-cylinder 410 to form the hollow portion 411. The outer wall 422 is formed with fitting holes 423 to 429 in correspondence to the protrusions 413 to 419. The protrusions 413 to 419 are fitted in the fitting holes 423 to 429 to form the second element cover 400.

Figure 8:
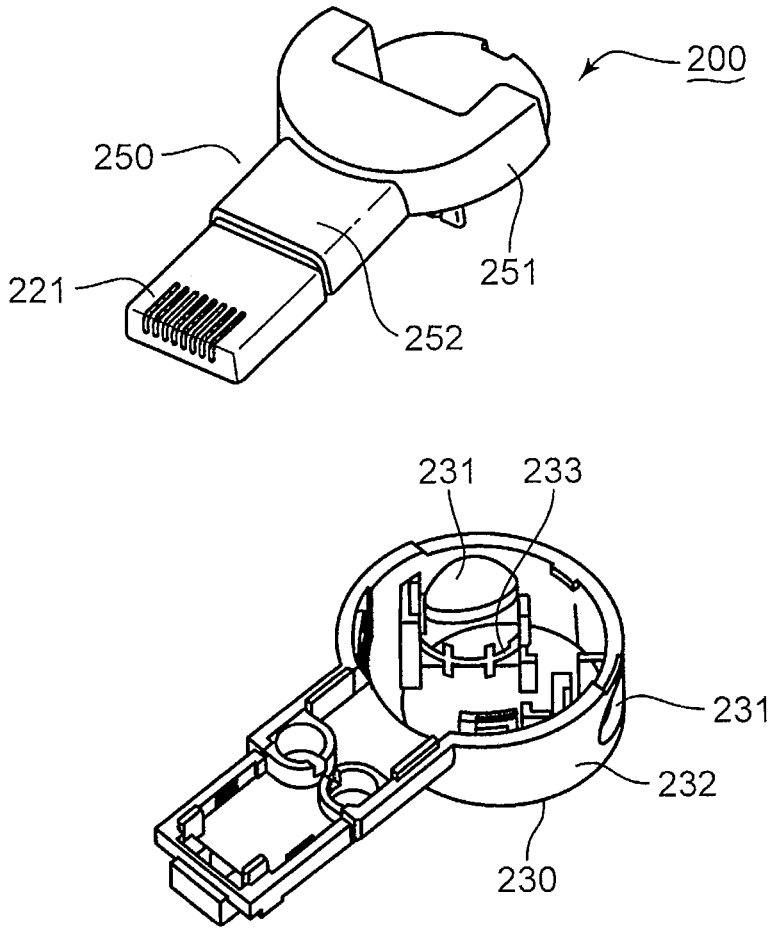
FIG. 8 is a schematic exploded perspective view of a housing of the antenna device shown in FIG. 1.
Figure 9:
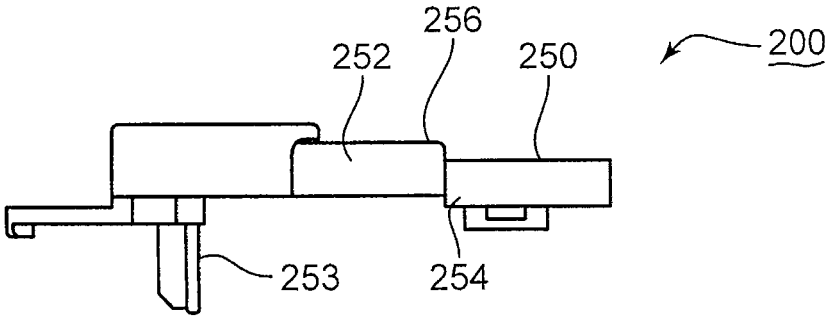
FIG. 9 is a schematic exploded side view of the housing shown in FIG. 8.
Figure 9:
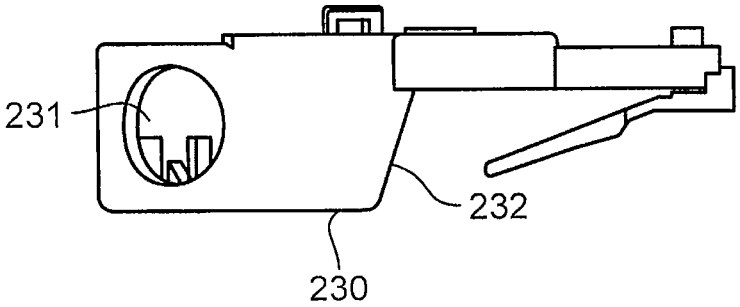

FIG. 8 is a schematic exploded perspective view of the housing 200. FIG. 9 is a schematic exploded side view of the housing 200. The housing 200 is described with reference to FIGS. 1, 8 and 9.

The housing 200 is formed of a first case 230, to which the first and second element covers 300, 400 are attached, and a second case 250, which is overlapped with the first case 230. The second case 250 is overlapped with the first case 230 to form a storage space in which the first and second antenna elements 110, 120 and the radio circuit 130 are stored.

The first case 230 includes an outer wall 232 formed with a pair of through holes 231 into which the first and second element covers 300, 400 are inserted. The second case 250 includes an outer wall 252 which defines the storage space with the outer wall 232 of the first case 230 so that the first and second antenna elements 110, 120 and the radio circuit 130 are stored in the storage space. The outer wall 252 of the second case 250 is formed with the LAN terminal 221.

Figure 10:
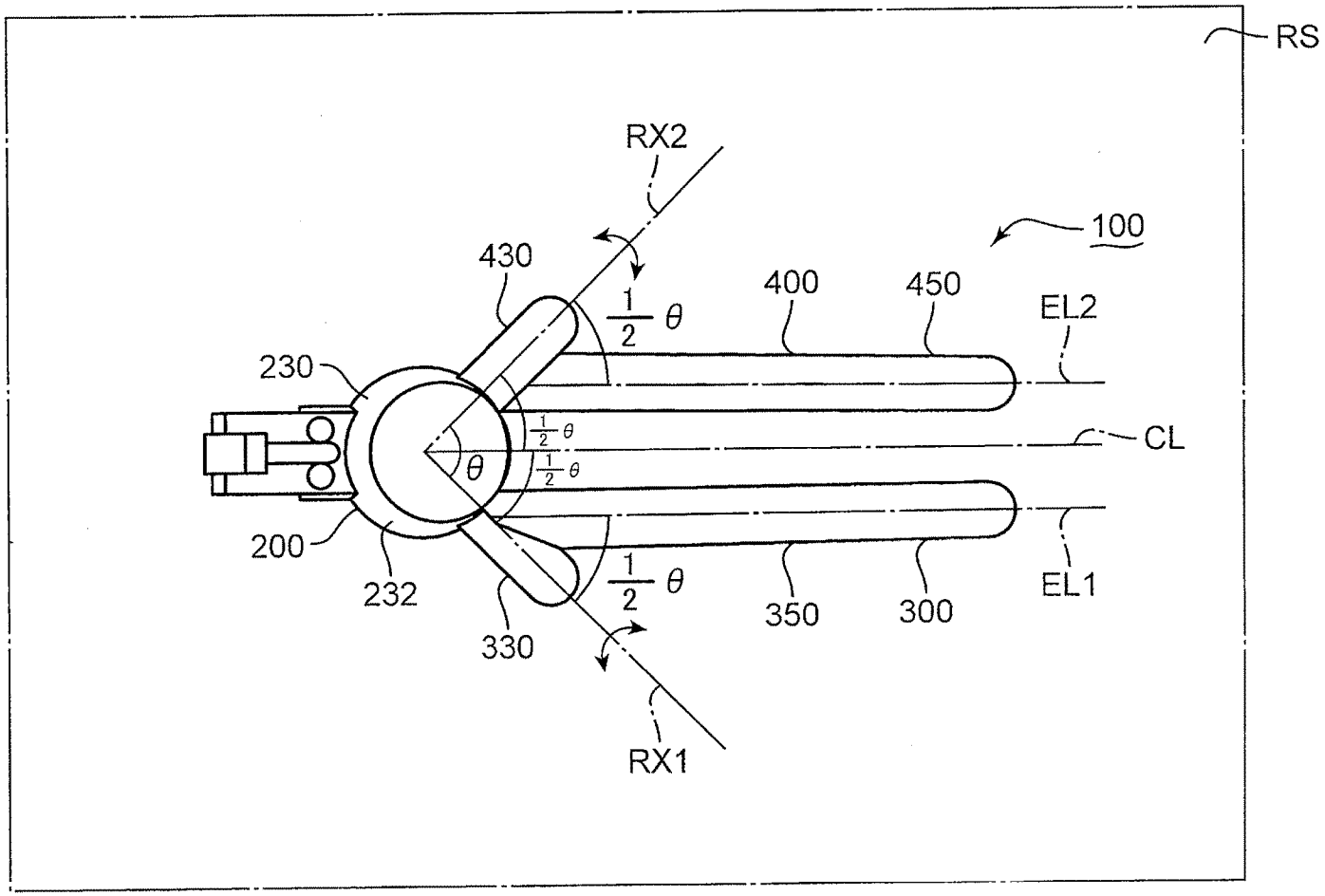
FIG. 10 is a schematic plan view of the antenna device shown in FIG. 1.

FIG. 10 is a schematic plan view of the antenna device 100. The antenna device 100 is described with reference to FIGS. 1, 8 and 10. FIG. 10 mainly shows the first case 230, the first and second element covers 300, 400.

The first element cover 300 includes a substantially cylindrical first rotary cylinder 330, which is inserted into the through hole 231 formed in the outer wall 232, and a first protruding cylinder 350, which protrudes from the first rotary cylinder 330. In FIG. 10, the rotational axis RX1 of the first rotary cylinder 330 is shown by using the one-dot chain line. The first rotary cylinder 330 held by the first case 230 rotates around the rotational axis RX1. The first rotary cylinder 330 protrudes from the first case 230 along the rotational axis RX1. In the present embodiment, the rotational axis RX1 is exemplified as the first rotational axis.

The second element cover 400 includes a substantially cylindrical second rotary cylinder 430, which is inserted into the through hole 231 that is formed in the outer wall 232, and a second protruding cylinder 450, which protrudes from the second rotary cylinder 430. In FIG. 10, the rotational axis RX2 of the second rotary cylinder 430 is shown by using the one-dot line. The second rotary cylinder 430 held by the first case 230 rotates around the rotational axis RX2. The second rotary cylinder 430 protrudes from the first case 230 along the rotational axis RX2. In the present embodiment, the rotational axis RX2 is exemplified as the second rotational axis.

In the present embodiment, the included angle θ between the rotational axes RX1, RX2 is "90°". In short, the rotational axis RX2 is perpendicular to the rotational axis RX1. In the present embodiment, the included angle θ is exemplified as the second included angle. The included angle θ may be set to an angle in a range from 60° to 120°. It may be preferable that the included angle θ is set to an angle in a range from 80° to 100°. If the included angle θ is set to an angle in the aforementioned range, it becomes easier to create an appropriate communication environment.

FIG. 10 shows the center line CL which halves the included angle θ. Since the inclination angle of each of the rotational axes RX1, RX2 from the center line CL corresponds to a half angle of the included angle θ, the inclination angle of each of the rotational axes RX1, RX2 from the center line CL is "45°" in the present embodiment. In the present embodiment, the half angle of the included angle θ is exemplified as the first and second inclination angles. If the included angle θ is set to an angle in a range from 60° to 120°, each of the first and second inclination angles is an angle in a range from 30° to 60°. If the included angle θ is set to an angle in a range from 80° to 100°, each of the first and second inclination angles is an angle in a range from 40° to 50°.

A geometrical plane defined so as to include the rotational axes RX1, RX2 is referred to as "reference surface RS" in the following description. In FIG. 10, the center line EL1 of the first protruding cylinder 350 of the first element cover 300 is shown by using the one-dot line. The center line EL2 of the second protruding cylinder 450 of the second element cover 400 is shown by using the one-dot line. The first protruding cylinder 350 extends along the center line EL1. The second protruding cylinder 450 extends along the center line EL2.

The center lines EL1, EL2 of the first and second element covers 300, 400 shown in FIG. 10 are situated on the reference surface RS. At this point, the center lines EL1, EL2 are parallel with the center line CL.

If the center line EL1 is present on the reference surface RS, the included angle between the center line EL1 and the rotational axis RX1 is equivalent to the corresponding angle of the included angle between the rotational axis RX1 and the center line CL. Consequently, the included angle (½ θ) between the center line EL1 and the rotational axis RX1 is "45°" in the present embodiment. The included angle between the center line EL1 and the rotational axis RX1 means the inclination angle of the first protruding cylinder 350 with respect to the first rotary cylinder 330. Consequently, the first protruding cylinder 350 protrudes at an angle of "45°" with respect to the first rotary cylinder 330 in the present embodiment.

If the center line EL2 is present on the reference surface RS, the included angle between the center line EL2 and the rotational axis RX2 is equivalent to the corresponding angle of the included angle between the rotational axis RX2 and the center line CL. Consequently, the included angle (½ θ) between the center line EL2 and the rotational axis RX2 is "45°" in the present embodiment. The included angle between the center line EL2 and the rotational axis RX2 means the inclination angle of the second protruding cylinder 450 with respect to the second rotary cylinder 430. Consequently, the second protruding cylinder 450 protrudes at an angle of "45°" with respect to the second rotary cylinder 430 in the present embodiment.

The included angle between the first and second protruding cylinders 350, 450 shown in FIG. 10 (i.e. the included angle between the first antenna element 110 stored in the first protruding cylinder 350 and the second antenna element 120 stored in the second protruding cylinder 450) is "0°". When the first and/or second protruding cylinders 350, 450 rotate around the rotational axes RX1, RX2 from the positions of the first and/or second protruding cylinders 350, 450 shown in FIG. 10, the included angle between the first and second antenna elements 110, 120 is increased.

Figure 11A:
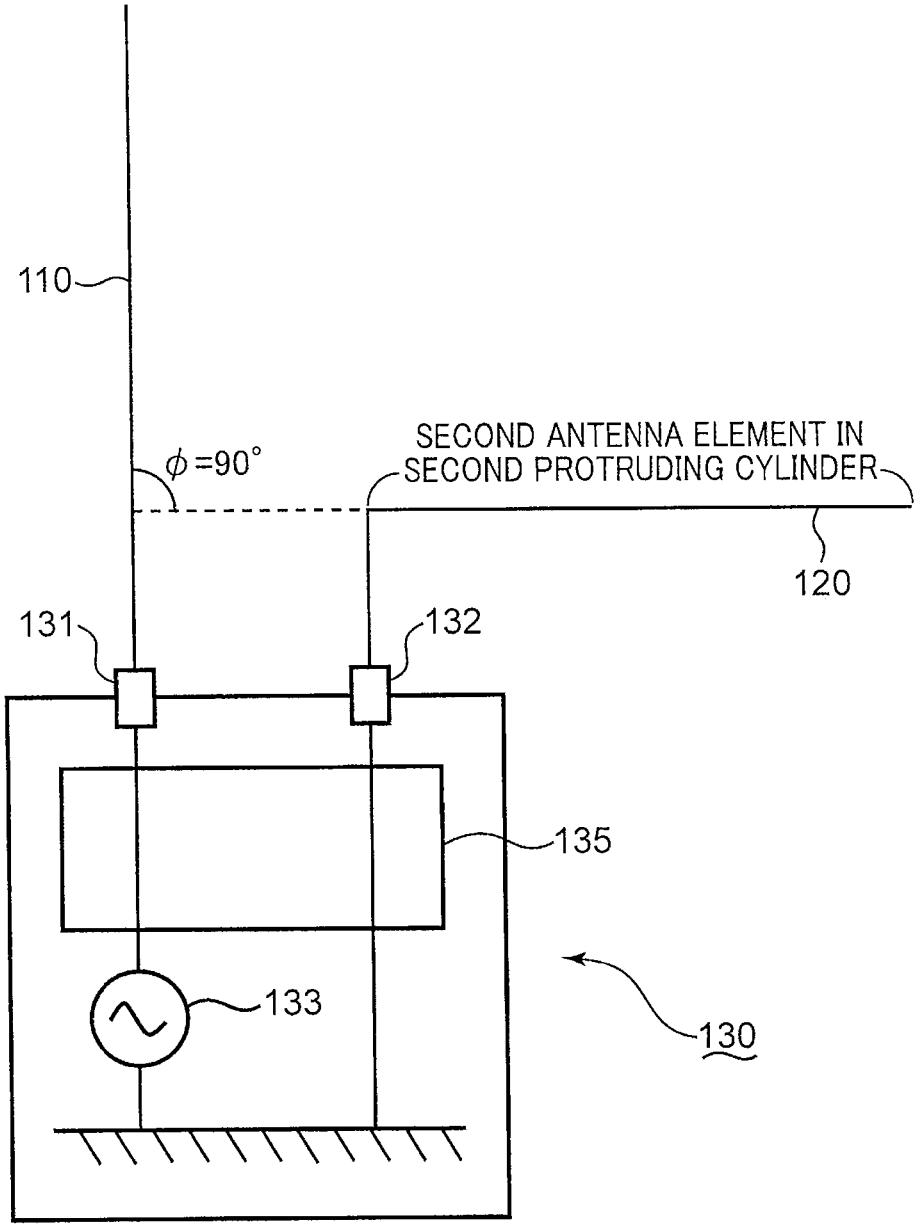
FIG. 11A is a schematic view of a radio circuit of the antenna device shown in FIG. 1.
Figure 11B:
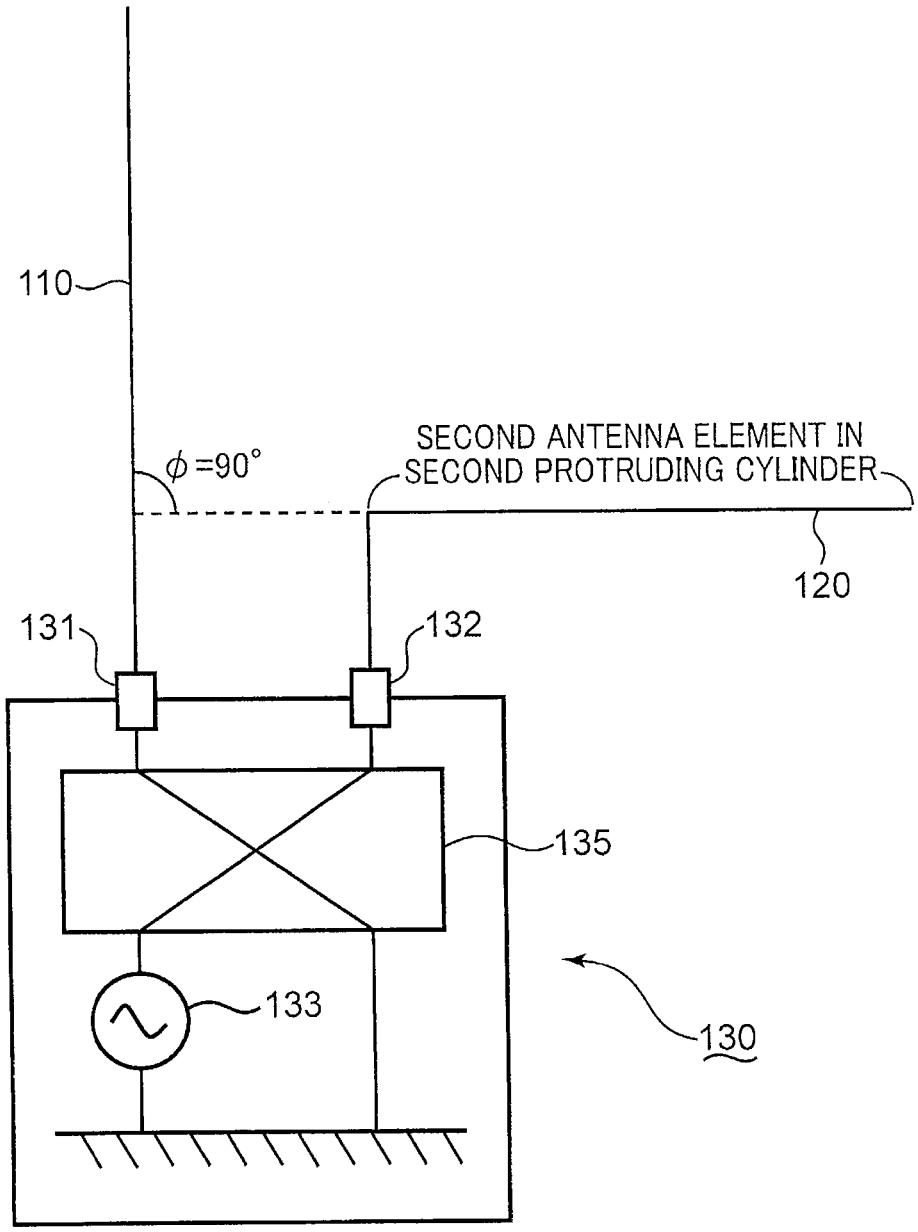
FIG. 11B is a schematic view of the radio circuit of the antenna device shown in FIG. 1.

FIGS. 11A and 11B are schematic views of the radio circuit 130 connected to the first antenna element 110 situated in the first protruding cylinder 350 held at the position shown in FIG. 10 and the second antenna element 120 situated in the second protruding cylinder 450 rotated by 180° from the position shown in FIG. 10. A preferable angular setting between the first and second antenna elements 110, 120 is described with reference to FIGS. 10 to 11B.

The radio circuit 130 includes a first power supply terminal 131 and a second power supply terminal 132. The proximal end of the first antenna element 110 is connected to the first power supply terminal 131. The distal end of the first antenna element 110 is a free end. The proximal end of the second antenna element 120 is connected to the second power supply terminal 132. The distal end of the second antenna element 120 is a free end.

The radio circuit 130 further includes a signal source 133 for supplying electric power to the first or second antenna element 110, 120. The signal source 133 functions as a transmission circuit and/or a reception circuit. Consequently, the antenna device 100 may transmit and receive radio waves.

The radio circuit 130 uses one of the first and second antenna elements 110, 120 as a ground line. The radio circuit 130 applies high-frequency voltage signals to the other of the first and second antenna elements 110, 120. Consequently, the antenna device 100 may be used as a general monopole antenna.

The radio circuit 130 further includes an antenna switch 135 configured to switch a power supply path from the signal source 133. The antenna switch 135 shown in FIG. 11A connects the first power supply terminal 131 with the signal source 133. In this case, the antenna device 100 uses the second antenna element 120 as a ground line. The antenna switch 135 shown in FIG. 11B connects the second power supply terminal 132 with the signal source 133. In this case, the antenna device 100 uses the first power supply terminal 131 as a ground line.

The antenna device 100 may be used as a general monopole antenna. However, unlike a common monopole antenna, the antenna device 100 includes both of a switching configuration as a diversity antenna and a configuration as a monopole antenna. A general monopole antenna requires a ground plane not smaller than an antenna element in the housing. However, since the antenna device 100 of the present embodiment includes both of the configurations of the diversity antenna and the monopole antenna, the ground plane is not necessary. Consequently, the antenna device 100 may be formed in a small size. If there is a small ground in the housing, the antenna device 100 of the present embodiment may perform operations similar to those of a dipole antenna.

As shown in FIGS. 11A and 11B, when the second element cover 400 rotates around the rotational axis RX2 by 180°, the included angle ϕ between the portion of the second antenna element 120 stored in the second protruding cylinder 450 and the first antenna element 110 is substantially 90°. If the orthogonal relationship between the first and second antenna elements 110, 120 is maintained, the antenna device 100 may appropriately operate as a monopole antenna.

Since the first antenna element 110 shown in FIG. 11A is connected to the signal source 133 using the antenna switch 135, the first antenna element 110 operates as a power supply element of a monopole antenna. Meanwhile, the second antenna element 120 functions as a ground line. Consequently, antenna radiation efficiency is increased.

Since the second antenna element 120 shown in FIG. 11B is connected to the signal source 133 using the antenna switch 135, the second antenna element 120 operates as a power supply element of a monopole antenna. Meanwhile, the first antenna element 110 functions as a ground line. Consequently, the antenna radiation efficiency is increased.

In general, it is known that the antenna radiation efficiency is maximized when the included angle between an antenna element, to which electric power is supplied, and an antenna element used as a ground line is substantially 90°.

In the present embodiment, the included angle between the first and second antenna elements 110, 120 is set to substantially 90° by rotation manipulation of the first and/or second element covers 300, 400.

If the included angle between the first and second antenna elements 110, 120 is set to 90°, a polarization plane of an electromagnetic wave emitted from the first antenna element 110 becomes orthogonal to a polarization plane of an electromagnetic wave emitted from the second antenna element 120. The orthogonal relationship of the polarization plane maximizes polarization diversity. Consequently, if a user rotates the first and/or second element covers 300, 400 to set the included angle between the first and second antenna elements 110, 120 to 90°, the antenna device 100 may operate with the maximized polarization diversity.

Figure 12A:
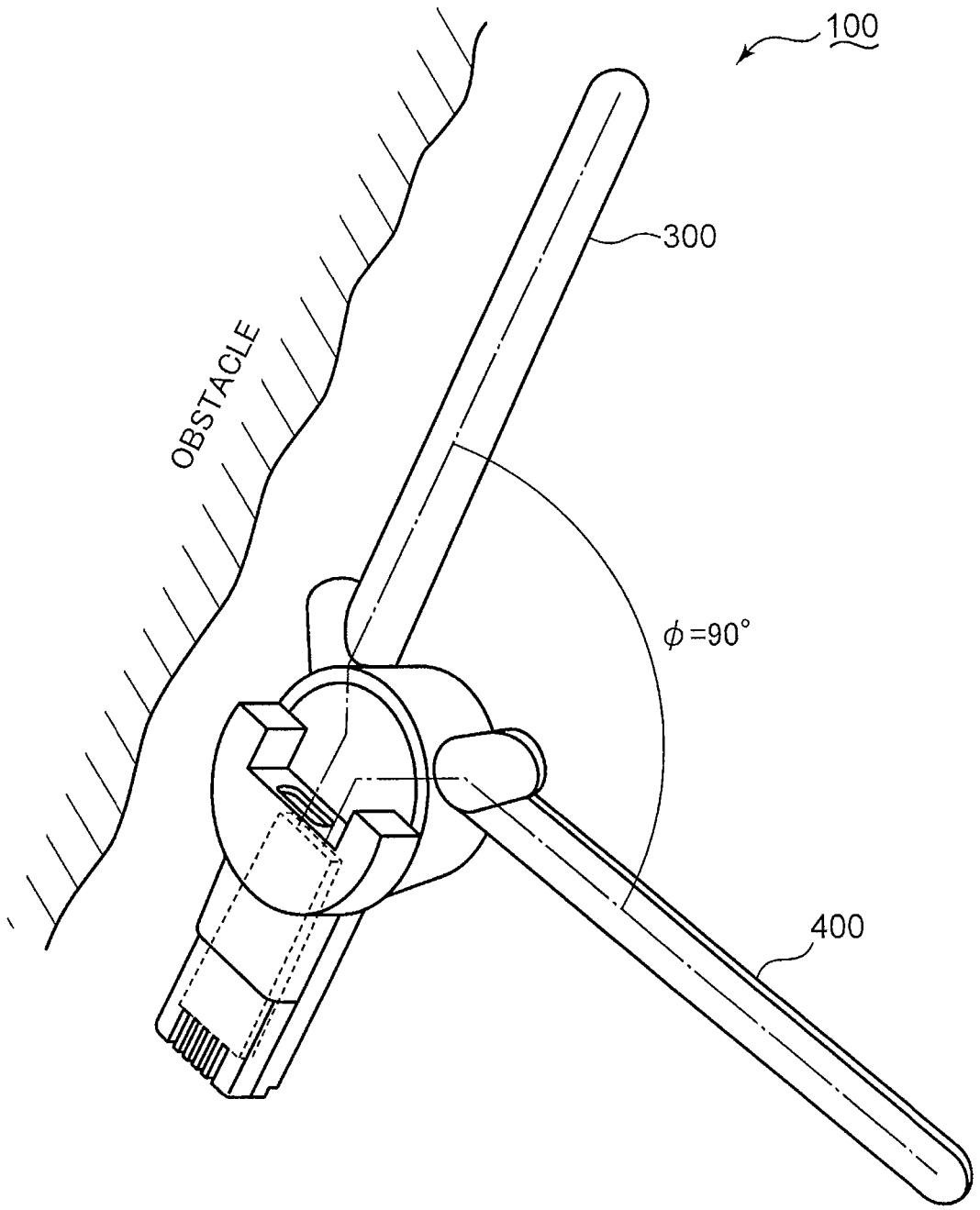
FIG. 12A is a perspective view of the antenna device shown in FIG. 1.
Figure 12B:
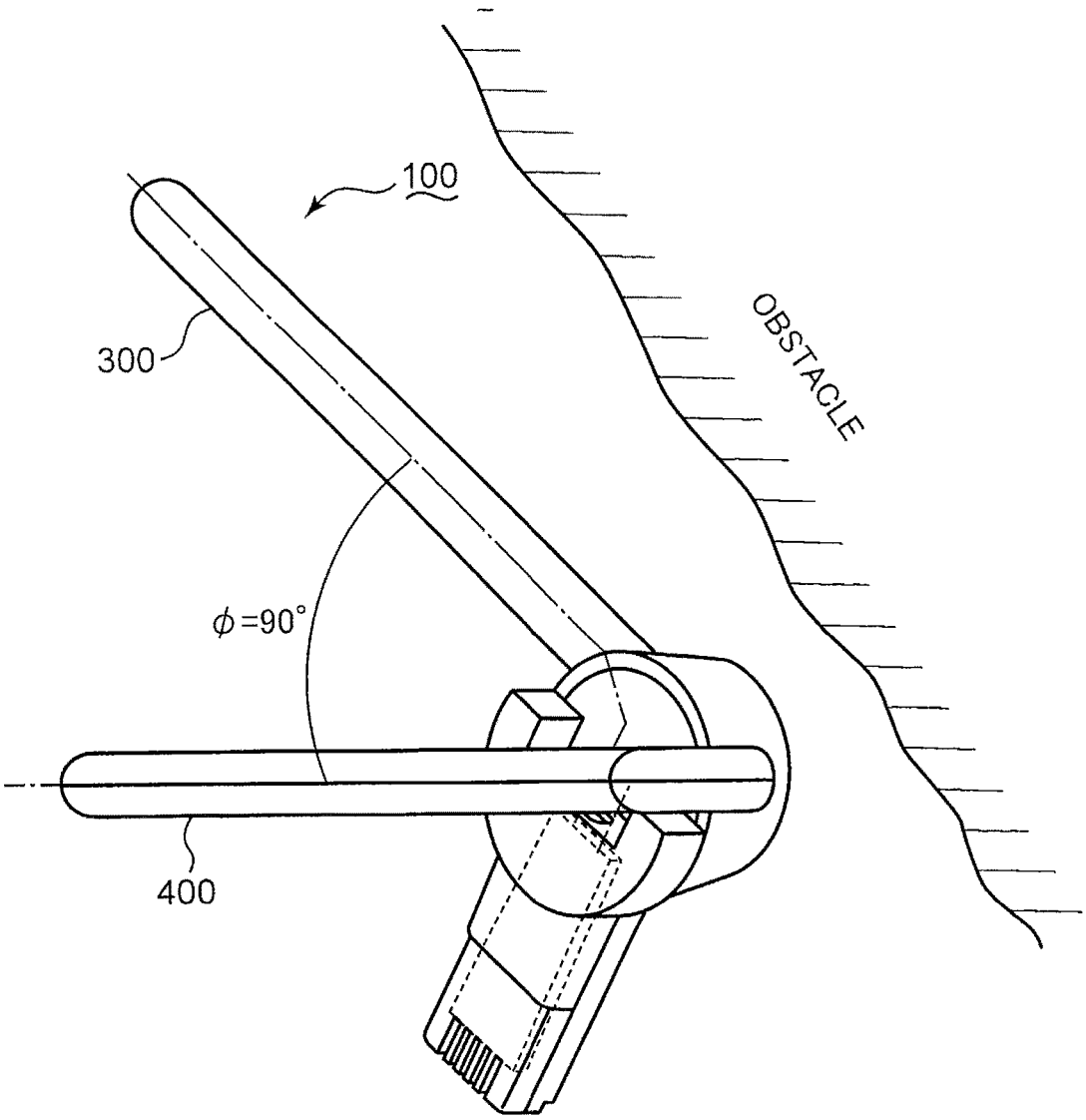
FIG. 12B is a perspective view of the antenna device shown in FIG. 1.
Figure 12C:
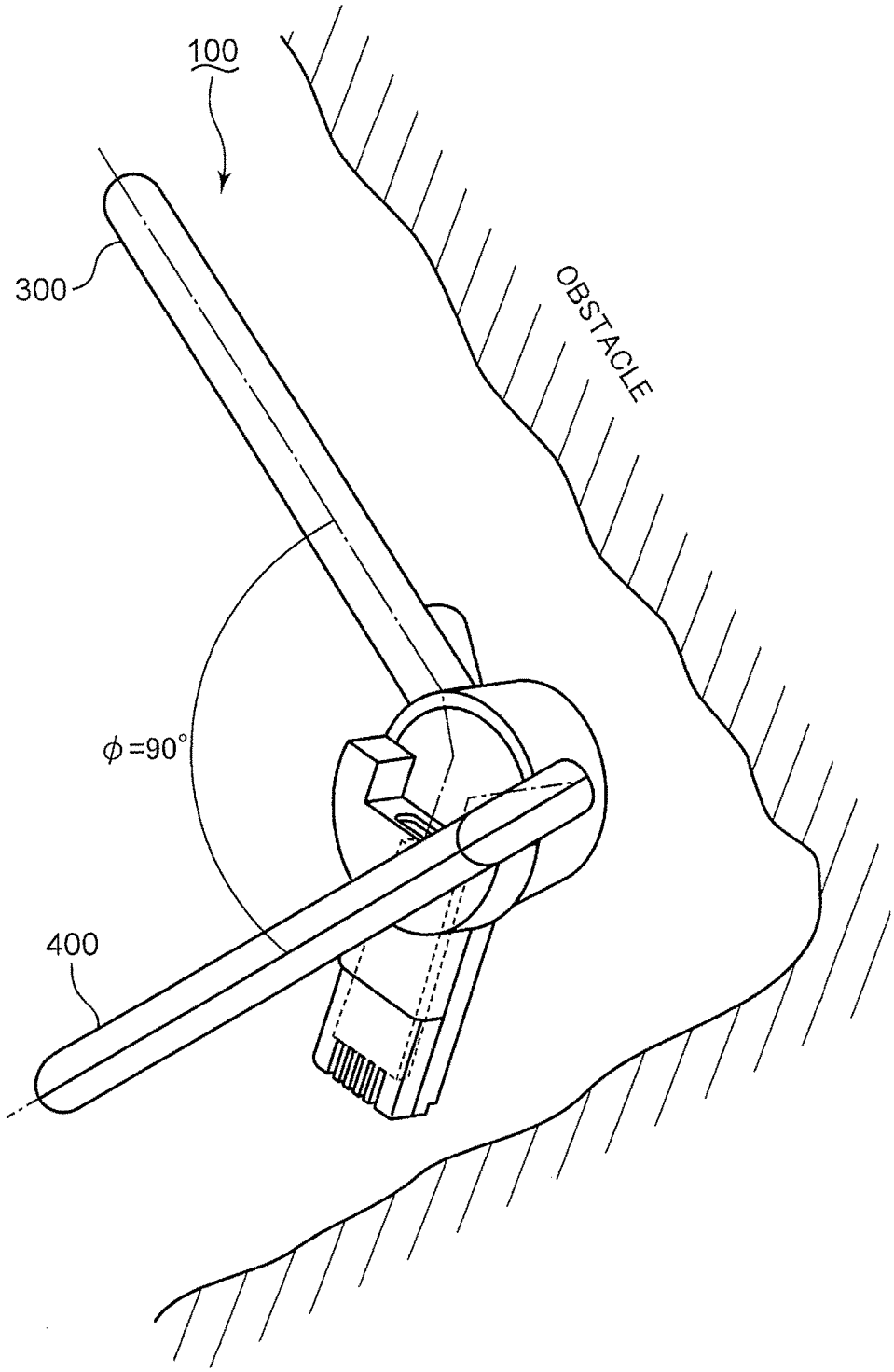
FIG. 12C is a perspective view of the antenna device shown in FIG. 1.

FIGS. 12A to 12C are perspective views of the antenna device 100. The angular setting of the first and second element covers 300, 400 is described with reference to FIGS. 3, 10 to 12C.

The first and second element covers 300, 400 of the antenna device 100 shown in FIGS. 12A to 12C are set so that the included angle between the first and second antenna elements 110, 120 is substantially 90°. However, FIGS. 12A to 12C show different rotational angles of the first and second element covers 300, 400 from the reference surface RS.

As described with reference to FIG. 3, the antenna device 100 is attached to various devices. Consequently, a usage environment of the antenna device 100 varies. For example, a shape of a space in which the antenna device 100 is placed depends on an orientation of the external device ED (portrait or landscape). Alternatively, the shape of the space in which the antenna device 100 is placed also depends on an orientation of the LAN port PT of the external device ED. In addition, a cable situated near the LAN port PT also influences the shape of the space given to the antenna device 100.

As shown in FIGS. 12A to 12C, the user may rotate the first and second element covers 300, 400 to avoid interference between the antenna device 100 and an obstacle. Consequently, the antenna device 100 may appropriately operate in various use environments.

Figure 13:
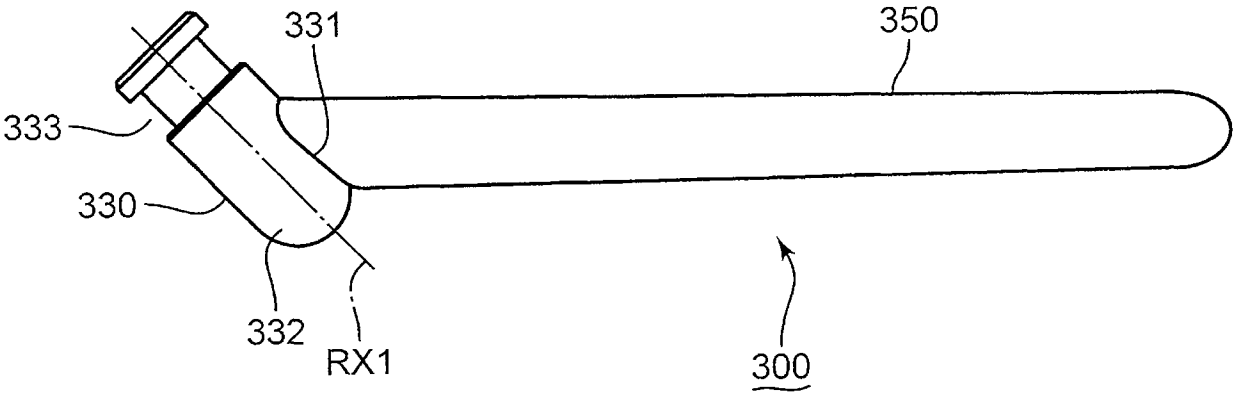
FIG. 13 is a schematic plan view of the first element cover shown in FIG. 4.
Figure 14:
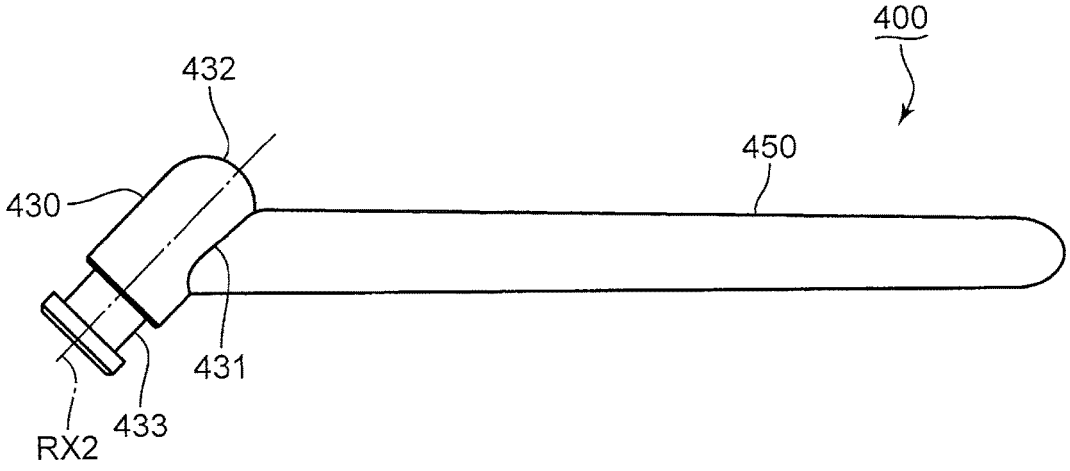
FIG. 14 is a schematic plan view of the second element cover shown in FIG. 4.

FIG. 13 is a schematic plan view of the first element cover 300. FIG. 14 is a schematic plan view of the second element cover 400. The first and second element covers 300, 400 are described with reference to FIGS. 10, 13 and 14.

As shown in FIG. 13, the first rotary cylinder 330 includes a distal end 332 which protrudes along the rotational axis RX1 from a joint portion 331 with the first protruding cylinder 350. Consequently, the user may intuitively realize the rotational axis RX1 on the basis of the protrusion direction of the distal end 332. Accordingly, the user may rotate the first element cover 300 around the rotational axis RX1 without applying an excessive load to the first element cover 300. In the present embodiment, the distal end 332 is exemplified as the first distal end.

As shown in FIG. 14, the second rotary cylinder 430 includes a distal end 432 which protrudes along the rotational axis RX2 from a joint portion 431 with the second protruding cylinder 450. Consequently, the user may intuitively realize the rotational axis RX2 on the basis of the protrusion direction of the distal end 432. Accordingly, the user may rotate the second element cover 400 around the rotational axis RX2 without applying an excessive load to the second element cover 400. In the present embodiment, the distal end 432 is exemplified as the second distal end.

As shown in FIG. 13, the first rotary cylinder 330 is formed with a first annular groove 333. As shown in FIG. 14, the second rotary cylinder 430 is formed with a second annular groove 433.

Figure 15A:
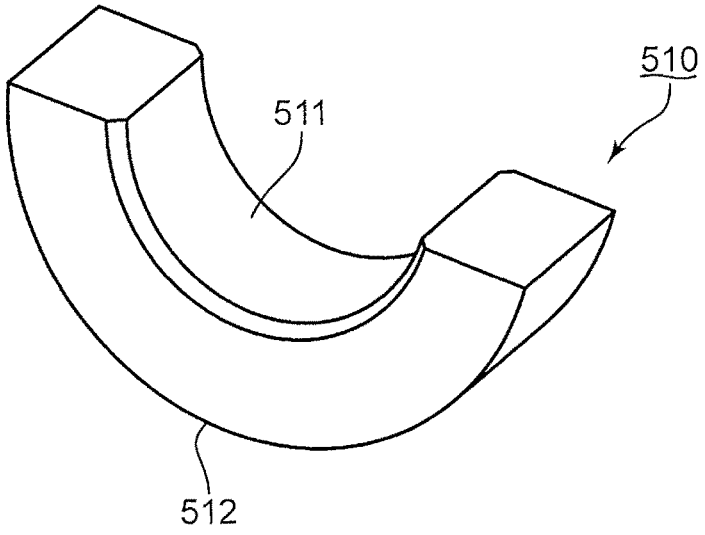
FIG. 15A is a schematic perspective view of a half ring fitted in a first annular groove of the first element cover shown in FIG. 13.
Figure 15B:
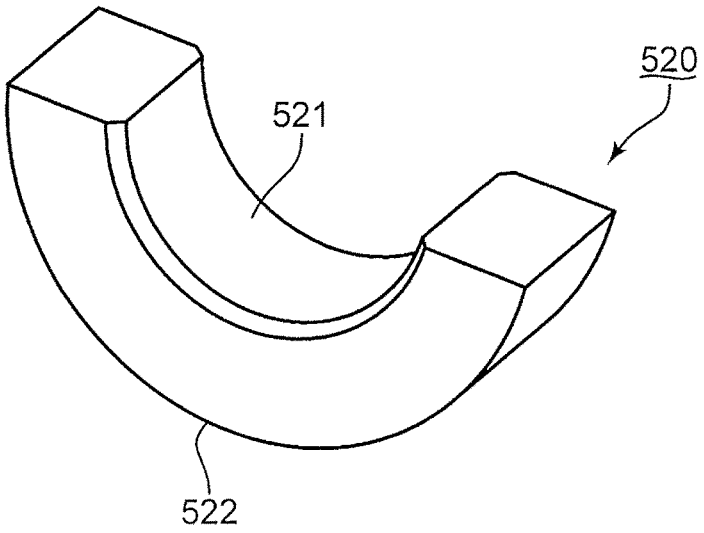
FIG. 15B is a schematic perspective view of a half ring fitted in a second annular groove of the second element cover shown in FIG. 14.
Figure 16:
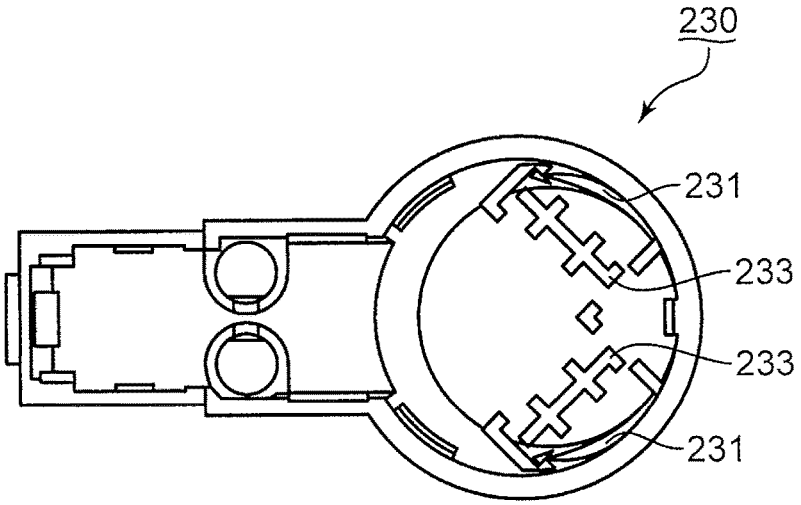
FIG. 16 is a schematic plan view of a first case of the housing shown in FIG. 9.

FIG. 15A is a schematic perspective view of a half ring 510 fitted in the first annular groove 333. FIG. 15B is a schematic perspective view of a half ring 520 fitted in the second annular groove 433. FIG. 16 is a schematic plan view of the first case 230. FIG. 16 shows the inner surface of the first case 230. A connection structure among the first and second element covers 300, 400 and the first case 230 is described with reference to FIGS. 8, 13 to 16.

As shown in FIGS. 8 and 16, the first case 230 includes a pair of holding portions 233 next to the paired through holes 231. Each of the holding portions 233 is formed in a substantially U-shape.

As shown in FIG. 15A, the half ring 510 is formed in a substantially C-shape. The half ring 510 includes an inner peripheral surface 511, which comes in close contact with the outer surface of the first rotary cylinder 330 formed with the first annular groove 333, and an outer peripheral surface 512 opposite to the inner peripheral surface 511. The outer peripheral surface 512 and the holding portion 233 are complementary to each other.

As shown in FIG. 15B, the half ring 520 is formed in a substantially C-shape. The half ring 520 includes an inner peripheral surface 521, which comes in close contact with the outer surface of the second rotary cylinder 430 formed with the second annular groove 433, and an outer peripheral surface 522 opposite to the inner peripheral surface 521. The outer peripheral surface 522 and the holding portion 233 are complementary to each other.

Figure 17:
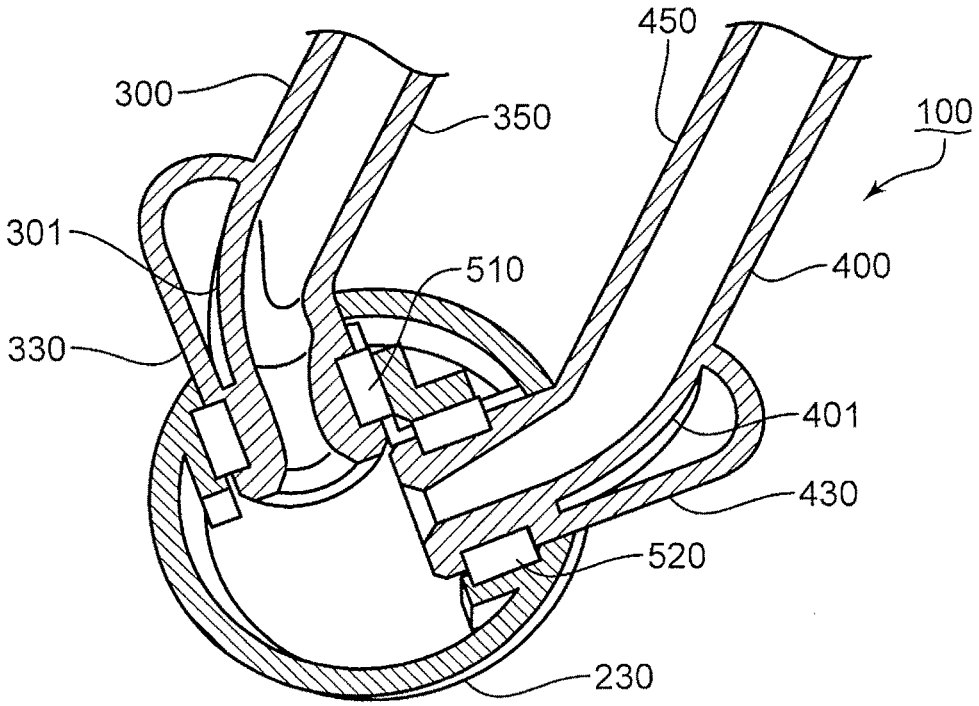
FIG. 17 is a schematic partial cross-sectional view of the antenna device shown in FIG. 1.

FIG. 17 is a schematic partial cross-sectional view of the antenna device 100. The connection structure of the first and second element covers 300, 400 to the first case 230 is further described with reference to FIGS. 8, 13, 14 and 17.

As shown in FIG. 17, the half ring 510 placed on the holding portion 233 is fitted in the first annular groove 333 formed in the first rotary cylinder 330. The half ring 510 holds the first rotary cylinder 330 in the first case 230. In the present embodiment, the half ring 510 is exemplified as the first holder.

As shown in FIG. 17, the half ring 520 placed on the holding portion 233 is fitted in the second annular groove 433 formed in the second rotary cylinder 430. The half ring 520 holds the second rotary cylinder 430 in the first case 230. In the present embodiment, the half ring 520 is exemplified as the second holder.

Figure 18:
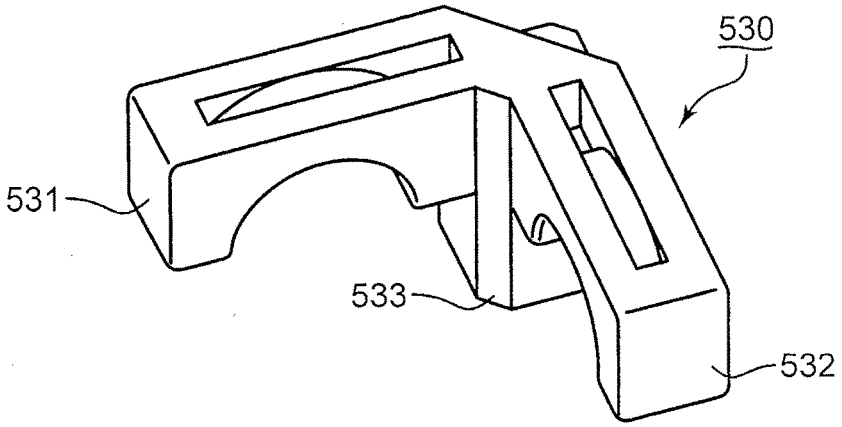
FIG. 18 is a schematic perspective view of a holding block configured to hold the first and second element covers with the half rings shown in FIGS. 15A and 15B.

FIG. 18 is a schematic perspective view of a holding block 530 configured to hold the first and second element covers 300, 400 with the half rings 510, 520. The holding block 530 is described with reference to FIGS. 13, 14, 17 and 18.

As shown in FIG. 17, the half ring 510 covers substantially a half of the circumference of the first annular groove 333 formed in the first rotary cylinder 330. The half ring 520 covers substantially a half of the circumference of the second annular groove 433 formed in the second rotary cylinder 430.

As shown in FIG. 18, the holding block 530 includes a first block 531, which is configured to cover the remaining half of the circumference of the first annular groove 333, a second block 532, which is configured to cover the remaining half of the circumference of the second annular groove 433, and a connecting block 533, which connects the first block 531 with the second block 532. An angle between the first and second blocks 531, 532 defined by the connecting block 533 is determined on the basis of the included angle between the first and second rotary cylinders 330, 430. Consequently, in the present embodiment, the second block 532 is connected to the first block 531 at an angle of 90° with respect to the first block 531.

Figure 19:
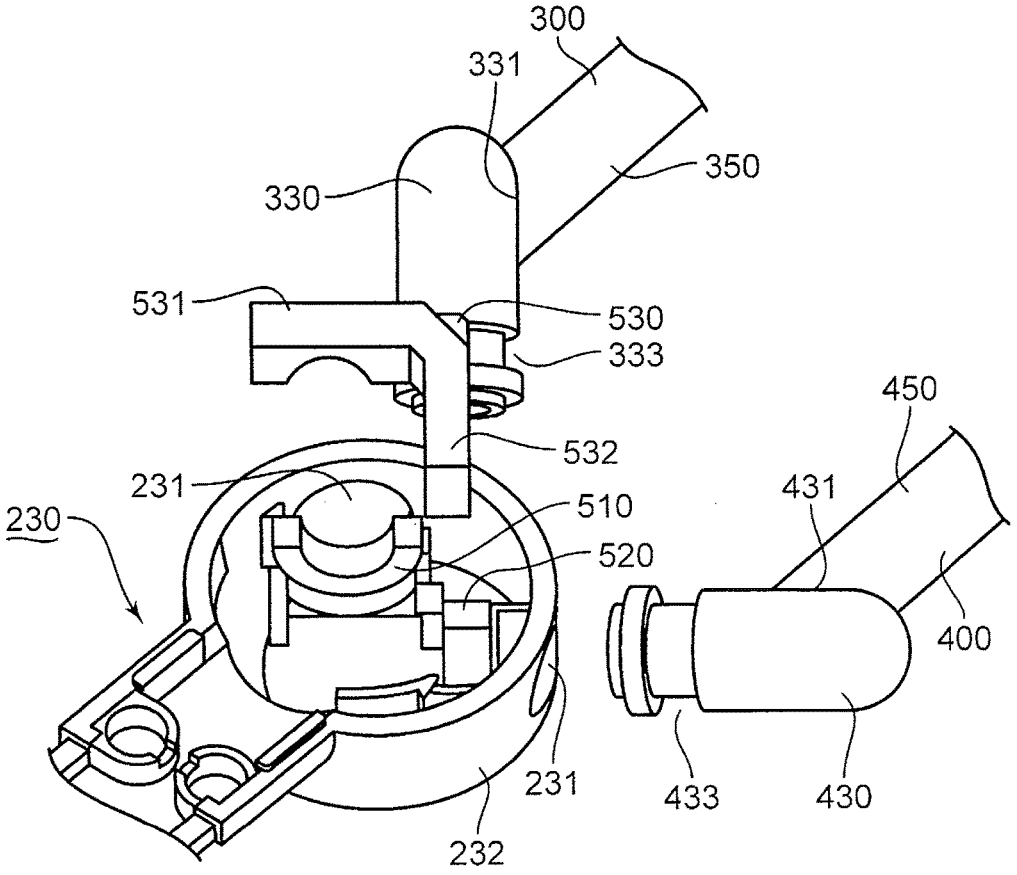
FIG. 19 is a schematic perspective view of the first case shown in FIG. 16.
Figure 20:
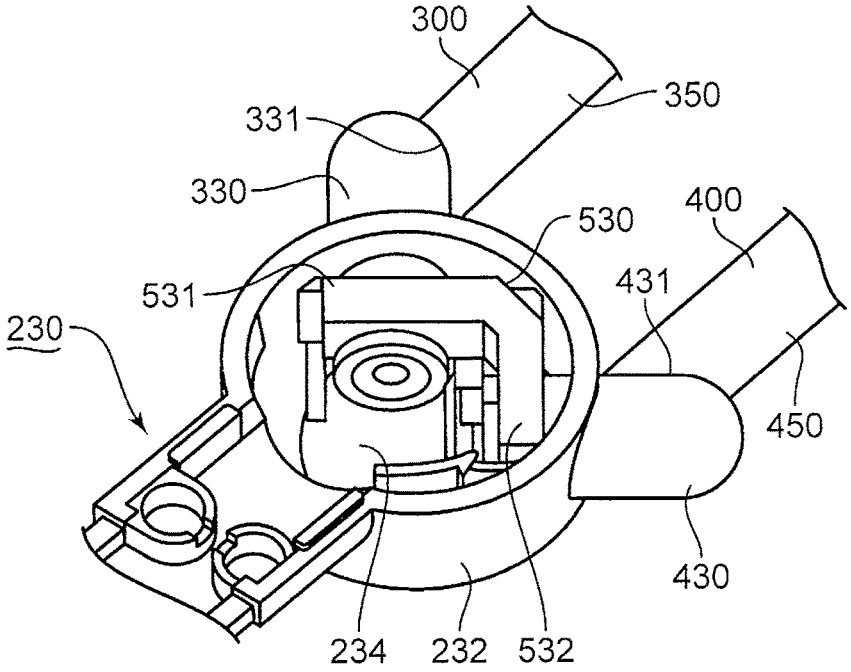
FIG. 20 is a schematic perspective view of the first case shown in FIG. 16.

FIG. 19 is a schematic perspective view of the first case 230 before incorporation between the first and second element covers 300, 400. FIG. 20 is a schematic perspective view of the first case 230 after the incorporation between the first and second element covers 300, 400. The incorporation among the first case 230, the first and second element covers 300, 400 is described with reference to FIGS. 19 and 20.

The first and second rotary cylinders 330, 430 are inserted into the through holes 231 formed in the first case 230. The half ring 510 is then fitted in the first annular groove 333 in the first case 230. The half ring 520 is fitted in the second annular groove 433 in the first case 230. Eventually, the holding block 530 is overlapped with the half rings 510, 520. Accordingly, the holding block 530 is fitted in the first and second annular grooves 333, 433. The first block 531 collaborates with the half ring 510 to hold the first rotary cylinder 330. The second block 532 collaborates with the half ring 520 to hold the second rotary cylinder 430. Consequently, the holding block 530 may hold the first and second rotary cylinders 330, 430 simultaneously. In the present embodiment, the holding block 530 is exemplified as the main holder.

The first element cover 300 is held in the first case 230 not only by the half ring 510 and the first block 531 but also by the outer wall 232 of the first case 230. Consequently, the holding structure for the first element cover 300 has high mechanical strength.

The second element cover 400 is held in the first case 230 not only by the half ring 520 and the second block 532 but also by the outer wall 232 of the first case 230. Consequently, the holding structure for the second element cover 400 has high mechanical strength.

The user manipulates the first and/or second element covers 300, 400 outside the first case 230. Consequently, the outer wall 232 is likely to cause high stress to the first and second rotary cylinders 330, 430.

The outer wall 232 supports the first rotary cylinder 330 in a region from the joint portion 331 between the first protruding cylinder 350 and the first rotary cylinder 330 to the first annular groove 333. An outer diameter of the region of the first rotary cylinder 330 supported by the outer wall 232 is larger than an outer diameter of the first rotary cylinder 330 defined by the first annular groove 333. Consequently, even when the outer wall 232 causes high stress to the first rotary cylinder 330, the first element cover 300 may bear the stress adequately.

The outer wall 232 supports the second rotary cylinder 430 in a region from the joint portion 431 between the second protruding cylinder 450 and the second rotary cylinder 430 to the second annular groove 433. An outer diameter of the region of the second rotary cylinder 430 supported by the outer wall 232 is larger than an outer diameter of the second rotary cylinder 430 defined by the second annular groove 433. Consequently, even when the outer wall 232 causes high stress to the second rotary cylinder 430, the second element cover 400 may bear the stress adequately.

Figure 21:
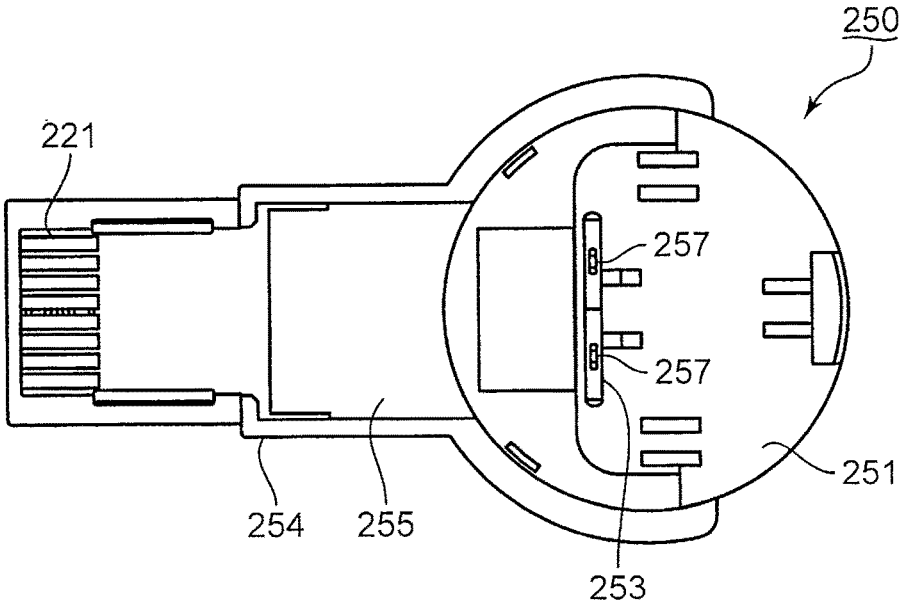
FIG. 21 is a schematic plan view of a second case of the housing shown in FIG. 9.

FIG. 21 is a schematic plan view of the second case 250. The second case 250 is described by using FIGS. 1, 9, 20 and 21. FIG. 21 mainly shows the inner surface facing the first case 230.

The second case 250 includes a cover portion 251 configured to cover an internal space 234 of the first case 230, in which the first and second rotary cylinders 330, 430 are partially stored, and a cable holding plate 253, which protrudes toward the first case 230 from substantially the center of the cover portion 251. The cable holding plate 253 protrudes into the internal space 234.

The second case 250 includes a substantially rectangular box-like storage portion 254 which protrudes from the cover portion 251. The LAN terminal 221 is formed along the distal edge of the storage portion 254. The radio circuit 130 is attached to a part between the cable holding plate 253 and the LAN terminal 221. In the following description, the inner surface of the storage portion 254 to which the radio circuit 130 is attached is referred to as the attachment surface 255. The surface opposite to the attachment surface 255 is referred to as the outer surface 256.

Figure 22:
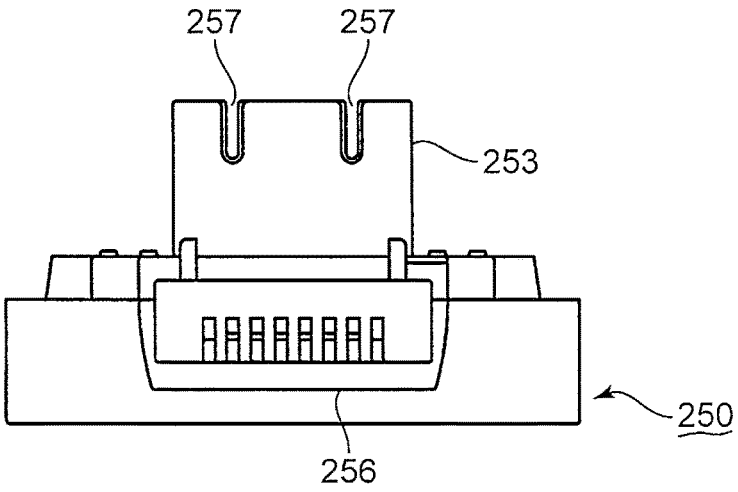
FIG. 22 is a front view of the second case shown in FIG. 21.

FIG. 22 is a front view of the second case 250. The second case 250 is further described with reference to FIGS. 1 and 22.

Paired slits 257 are formed in the cable holding plate 253. The first and second antenna elements 110, 120 are inserted into the paired slits 257.

<Method for Assembling Antenna Device>

Figure 23:
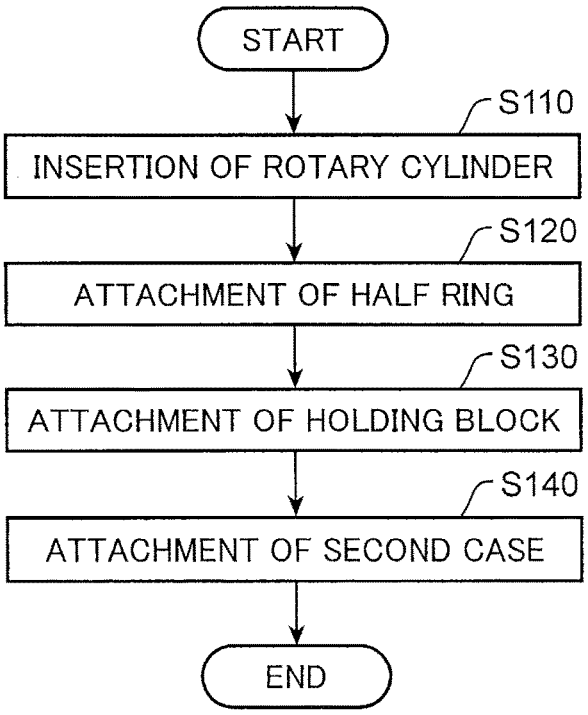
FIG. 23 is a flowchart schematically showing a method for assembling the antenna device depicted in FIG. 1.

FIG. 23 is a flowchart schematically showing a method for assembling the antenna device 100. FIGS. 24A to 24D are schematic views of the antenna device 100 assembled on the basis of the flowchart of FIG. 23. The method for assembling the antenna device 100 is described with reference to FIGS. 8, 23 to 24D.

(Step S110)

Figure 24A:
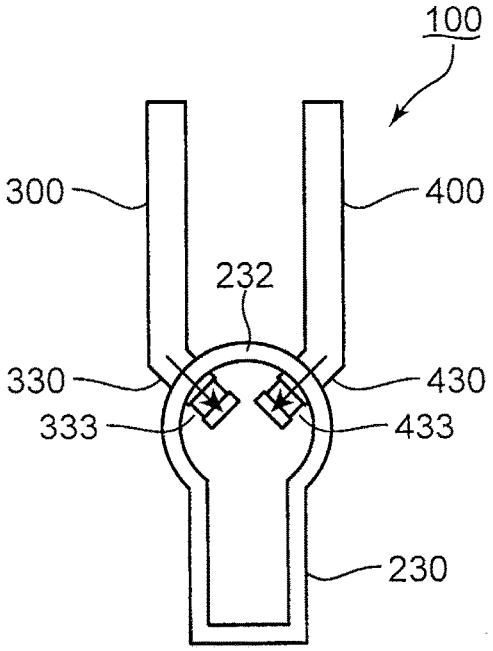
FIG. 24A is a schematic view of the antenna device assembled on the basis of the flowchart shown in FIG. 23.

In Step S110, the first and second rotary cylinders 330, 430 are inserted into the through holes 231 formed in the outer wall 232 of the first case 230 (c.f. FIGS. 8 and 24A). Accordingly, the first and second element covers 300, 400 are connected to the first case 230. Step S120 is then executed.

(Step S120)

Figure 24B:
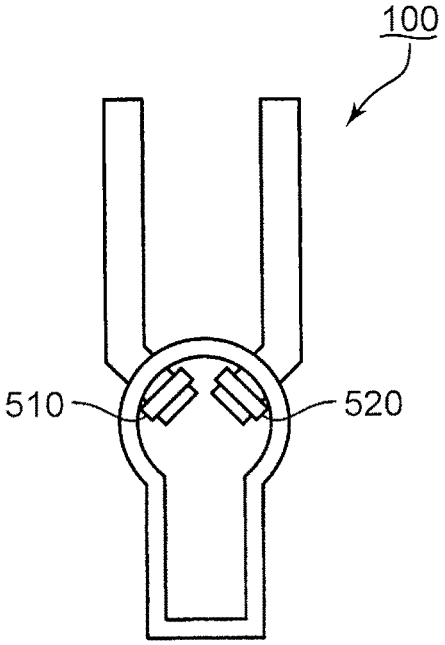
FIG. 24B is a schematic view of the antenna device assembled on the basis of the flowchart shown in FIG. 23.

In Step S120, the half ring 510 is fitted in the first annular groove 333 whereas the half ring 520 is fitted in the second annular groove 433 (c.f. FIGS. 24A and 24B). Step S130 is then executed.

(Step S130)

Figure 24C:
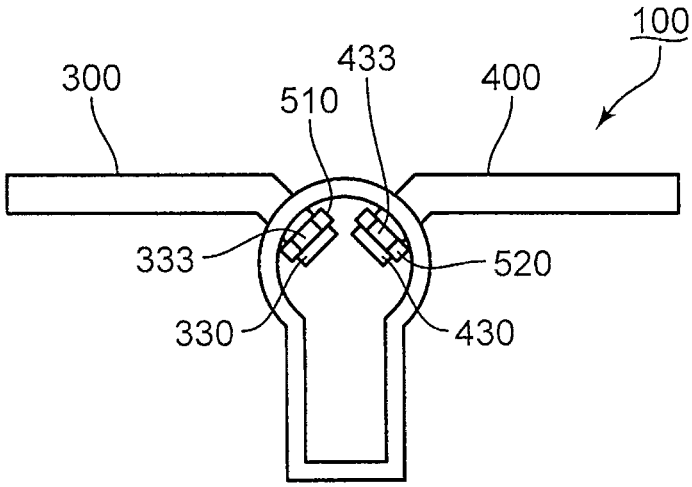
FIG. 24C is a schematic view of the antenna device assembled on the basis of the flowchart shown in FIG. 23.
Figure 24D:
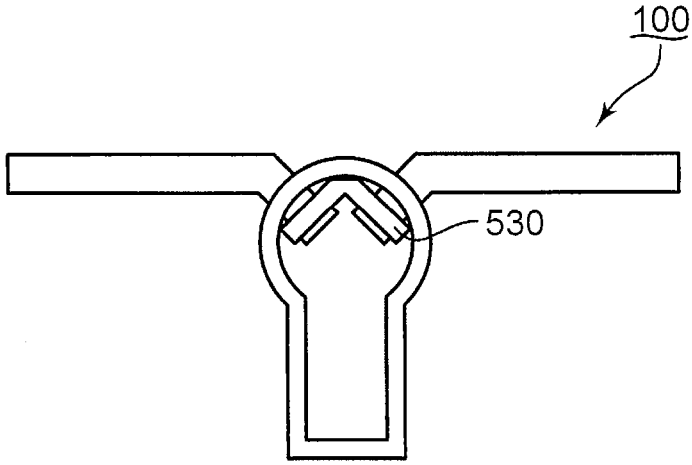
FIG. 24D is a schematic view of the antenna device assembled on the basis of the flowchart shown in FIG. 23.

In Step S130, the first and second element covers 300, 400 are rotated by 180° (c.f. FIG. 24C). Consequently, the half ring 510 is situated between the first rotary cylinder 330 and the holding portion 233 whereas the half ring 520 is situated between the second rotary cylinder 430 and the holding portion 233 (c.f. FIGS. 8 and 24C). Accordingly, the first and second annular grooves 333, 433 are exposed. The holding block 530 is fitted in the exposed first and second annular grooves 333, 433 (c.f. FIGS. 24C and 24D). Step S140 is then executed.

(Step S140)

In Step S140, the second case 250 is overlapped with the first case 230 (c.f. FIG. 8). Accordingly, the antenna device 100 is completed.

Figure 25:
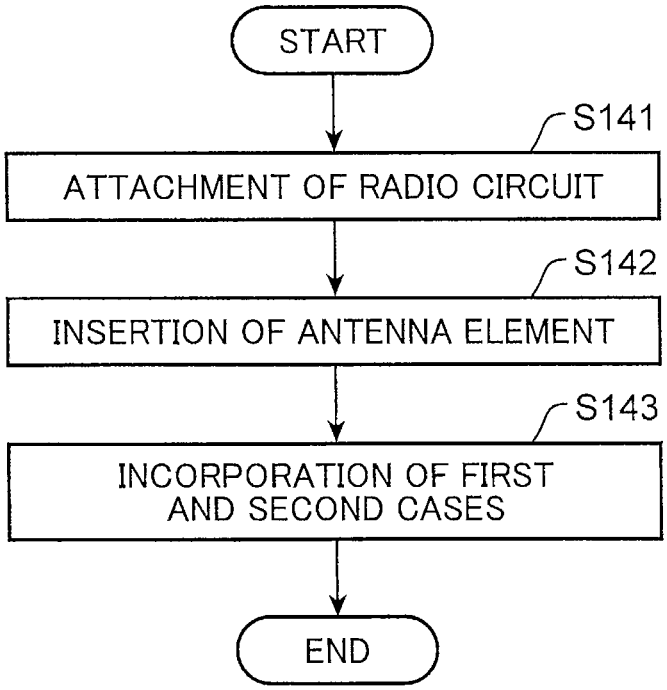
FIG. 25 is a schematic flowchart of assembly processes in Step S140 of the flowchart shown in FIG. 23.
Figure 26A:
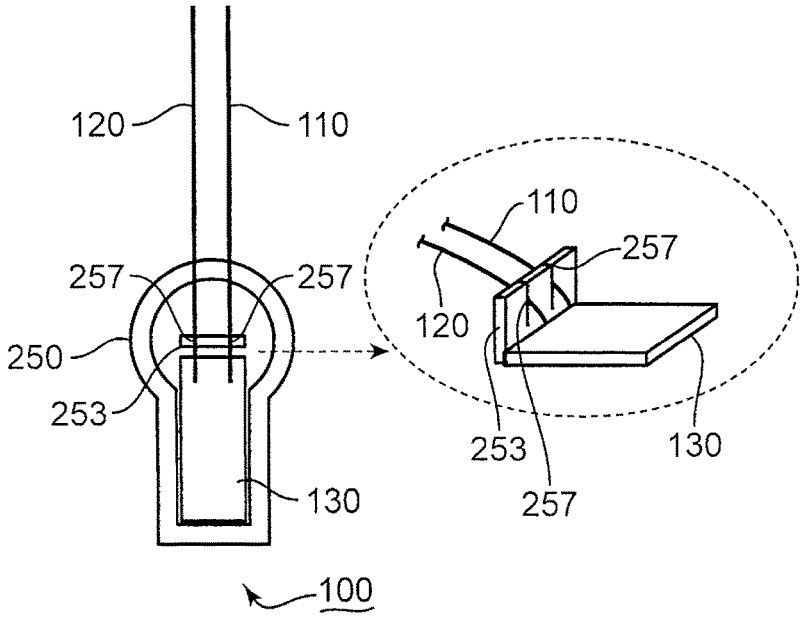
FIG. 26A is a schematic view of the antenna device assembled on the basis of the flowchart shown in FIG. 25.
Figure 26B:
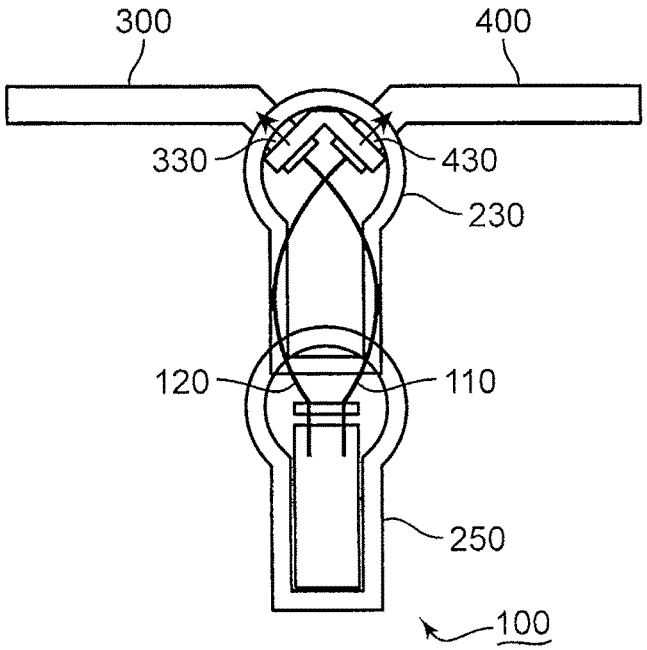
FIG. 26B is a schematic view of the antenna device assembled on the basis of the flowchart shown in FIG. 25.
Figure 26C:
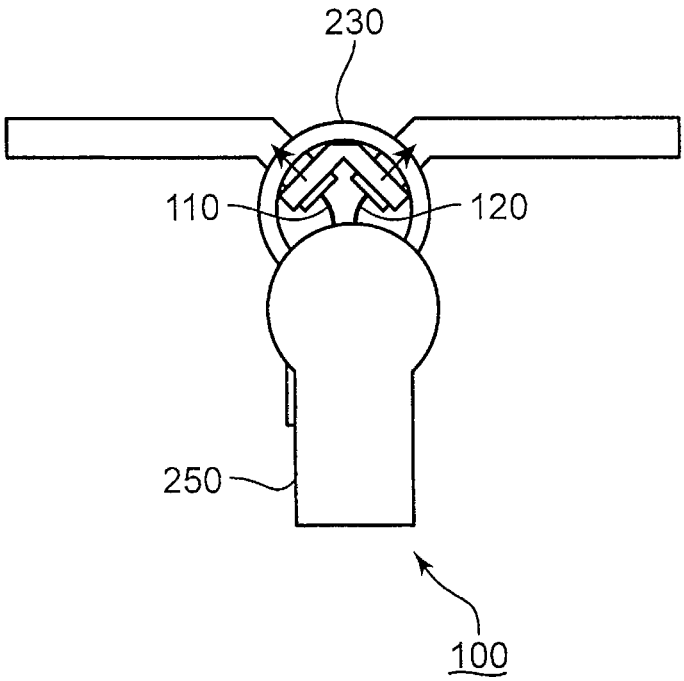
FIG. 26C is a schematic view of the antenna device assembled on the basis of the flowchart shown in FIG. 25.

FIG. 25 is a schematic flowchart of assembly processes in Step S140 described above. FIGS. 26A to 26C are schematic views of the antenna device 100 assembled on the basis of the flowchart of FIG. 25. The assembly processes in Step S140 are further described with reference to FIGS. 17, 21, 22, 25 to 26C.

(Step S141)

In Step S141, as shown in FIG. 26A, the radio circuit 130, to which the first and second antenna elements 110, 120 are soldered, is prepared. The first and second antenna elements 110, 120 are inserted into the paired slits 257 formed in the cable holding plate 253. The radio circuit 130 is mounted on the attachment surface 255 (c.f. FIG. 21) of the second case 250. Step S142 is then executed.

(Step S142)

In Step S142, as shown in FIG. 26B, the second case 250 is placed so that the outer surface 256 (c.f. FIG. 22) of the second case 250 faces the first case 230. The first antenna element 110 intersects with the second antenna element 120. The first antenna element 110 is then inserted into the first element cover 300. The second antenna element 120 is inserted into the second element cover 400. Due to the intersection between the first and second antenna elements 110, 120, the orientations of the first and second rotary cylinders 330, 430 substantially match the extension directions of the first and second antenna elements 110, 120. Therefore, it becomes easy to insert the first and second antenna elements 110, 120 via the first and second rotary cylinders 330, 430.

As shown in FIG. 17, the first element cover 300 includes a guide wall 301 which guides entry of the first antenna element 110 from the first rotary cylinder 330 to the first protruding cylinder 350. The second element cover 400 includes a guide wall 401 which guides entry of the second antenna element 120 from the second rotary cylinder 430 to the second protruding cylinder 450. Consequently, the first and second antenna elements 110, 120 may smoothly enter up to the distal ends of the first and second protruding cylinders 350, 450.

(Step S143)

In Step S143, as shown in FIG. 26C, the second case 250 is reversed so that the intersection between the first and second antenna elements 110, 120 disappears. The second case 250 is then incorporated with the first case 230. Consequently, the antenna device 100 is completed.

Various technologies described in the context of the aforementioned embodiment mainly include the following features.

An antenna device according to one aspect of the aforementioned embodiment includes a first antenna element and a second antenna element which transmit and receive a radio wave, a housing which stores a processor configured to process a signal in response to the radio wave, a first element cover configured to store the first antenna element, and a second element cover configured to store the second antenna element. The first element cover includes a first rotary cylinder, which is held by the housing and rotatable around a first rotational axis, and a first protruding cylinder, which protrudes from the first rotary cylinder, the first rotary cylinder protruding from the housing along the first rotational axis. The second element cover includes a second rotary cylinder, which is held by the housing and rotatable around a second rotational axis, and a second protruding cylinder which protrudes from the second rotary cylinder, the second rotary cylinder protruding from the housing along the second rotational axis. A first included angle defined between the first protruding cylinder, which stores the first antenna element, and the second protruding cylinder, which stores the second antenna element, is changed by rotation of at least one of the first and second rotary cylinders.

According to the aforementioned configuration, the first and second antenna elements which transmit and receive a radio wave are stored in the first and second element covers, respectively. The first rotary cylinder of the first element cover held by the housing, which stores the processor for processing a signal in response to the radio wave, rotates around the first rotational axis. The first rotary cylinder protrudes from the housing along the first rotational axis. The second rotary cylinder of the second element cover held by the housing rotates around the second rotational axis. The second rotary cylinder protrudes from the housing along the second rotational axis. The first and second protruding cylinders protrude from the first and second rotary cylinders, respectively. Since the first included angle defined between the first protruding cylinder, which stores the first antenna element, and the second protruding cylinder, which stores the second antenna element, is changed by rotation of at least one of the first and second rotary cylinders, an appropriate communication environment is created. Consequently, the antenna device may achieve good quality communication.

In the aforementioned configuration, a first inclination angle of the first rotational axis with respect to a center line, which halves a second included angle between the first and second rotational axes, and a second inclination angle of the second rotational axis with respect to the center line may be ranged from 30° to 60°.

According to the aforementioned configuration, since the first inclination angle of the first rotational axis with respect to the center line, which halves the second included angle between the first and second rotational axes, and the second inclination angle of the second rotational axis with respect to the center line is ranged from 30° to 60°, it becomes easier for a user to appropriately set the first included angle. Consequently, the antenna device may achieve good quality communication.

In the aforementioned configuration, the first and second inclination angles may be ranged from 40° to 50°.

According to the aforementioned configuration, since the first and second inclination angles are ranged from 40° to 50°, it becomes easier for the user to appropriately set the first included angle. Consequently, the antenna device may achieve good quality communication.

In the aforementioned configuration, the first protruding cylinder may protrude from the first rotary cylinder at the first inclination angle. The second protruding cylinder may protrude from the second rotary cylinder at the second inclination angle.

According to the aforementioned configuration, since the first protruding cylinder protrudes from the first rotary cylinder at the first inclination angle and the second protruding cylinder protrudes from the second rotary cylinder at the second inclination angle, it becomes easier for the user to appropriately set the first included angle. Accordingly, the antenna device may achieve good quality communication.

In the aforementioned configuration, the first and second protruding cylinders situated on a reference surface defined by the first and second rotational axes may extend along the center line.

According to the aforementioned configuration, since the first and second protruding cylinders situated on the reference surface defined by the first and second rotational axes extend along the center line, it becomes easier for the user to appropriately set the first included angle. Consequently, the antenna device may achieve good quality communication.

In the aforementioned configuration, the first rotary cylinder may include a first distal end which protrudes from a joint portion between the first rotary cylinder and the first protruding cylinder along the first rotational axis. The second rotary cylinder may include a second distal end which protrudes from a joint portion between the second rotary cylinder and the second protruding cylinder along the second rotational axis.

According to the aforementioned configuration, since the first rotary cylinder includes the first distal end which protrudes from the joint portion between the first rotary cylinder and the first protruding cylinder along the first rotational axis, the user may intuitively rotate the first rotary cylinder around the first rotational axis. Since the second rotary cylinder includes the second distal end which protrudes from the joint portion between the second rotary cylinder and the second protruding cylinder along the second rotational axis, the user may intuitively rotate the second rotary cylinder around the second rotational axis. Consequently, it becomes easier for the user to appropriately set the first included angle. Accordingly, the antenna device may achieve good quality communication.

In the aforementioned configuration, the antenna device may further include a first holder configured to hold the first rotary cylinder in the housing, and a second holder configured to hold the second rotary cylinder in the housing. The first rotary cylinder may be formed with a first annular groove depressed so that the first holder is fitted in the first annular groove. The second rotary cylinder may be formed with a second annular groove depressed so that the second holder is fitted in the second annular groove. The housing may include an outer wall formed with through holes through which the first and second rotary cylinders extend. An outer diameter of the first rotary cylinder held by the outer wall may be larger than an outer diameter of the first rotary cylinder defined by the first annular groove. An outer diameter of the second rotary cylinder held by the outer wall may be larger than an outer diameter of the second rotary cylinder defined by the second annular groove.

According to the aforementioned configuration, since the first rotary cylinder is held by the first holder fitted in the first annular groove in the housing and the outer wall of the housing, mechanical strength of the first element cover is increased. Since the second rotary cylinder is held by the second holder fitted in the second annular groove in the housing and the outer wall of the housing, mechanical strength of the second element cover is increased.

Since the outer diameter of the first rotary cylinder held by the outer wall is larger than the outer diameter of the first rotary cylinder defined by the first annular groove, there may be little damage to the first rotary cylinder resultant from stress concentration given to the first rotary cylinder by the outer wall. Since the outer diameter of the second rotary cylinder held by the outer wall is larger than the outer diameter of the second rotary cylinder defined by the second annular groove, there may be little damage to the second rotary cylinder resultant from stress concentration given to the second rotary cylinder by the outer wall.

In the aforementioned configuration, the antenna device may further include a main holder, which is overlapped with the first and second holders and fitted in the first and second annular grooves. The main holder may hold the first and second rotary cylinders simultaneously.

According to the aforementioned configuration, the main holder which is overlapped with the first and second holders is fitted in the first and second annular grooves. Since the main holder holds the first and second rotary cylinders simultaneously, a positional relationship between the first and second element covers is appropriately maintained. Consequently, appropriate communication environment is maintained.

In the aforementioned configuration, the housing may include a first case, which has the outer wall, and a second case, which is overlapped with the first case. The second case may include an attachment surface to which the processor is attached.

According to the aforementioned configuration, the first and second element covers are attached to the first case. The processor is attached to the second case. Consequently, it becomes easy to assemble the antenna device.

In the aforementioned configuration, the housing, the first element cover and the second element cover may be made of resin.

According to the aforementioned configuration, since the housing, the first element cover and the second element cover are made of resin, the antenna device becomes inexpensive.

In the aforementioned configuration, the housing may include a connector connected to an actuator which executes a predetermined operation in response to a processing signal output from the processor. The connector may be detachable from the actuator.

According to the aforementioned configuration, the antenna device is connected to the actuator via the connector. The actuator executes a predetermined operation in response to a processing signal processed by the processor. The connector is detachable from the actuator. As described above, since the first included angle defined between the first protruding cylinder, which stores the first antenna element, and the second protruding cylinder, which stores the second antenna element, is changed by rotation of at least one of the first and second rotary cylinders, an appropriate communication environment is created even when the antenna device attached to the actuator is placed in a limited space. Accordingly, the antenna device may achieve good quality communication.

A manufacturing method for the antenna device according to another aspect of the aforementioned embodiment includes steps of: inserting the first and second rotary cylinders into the through holes to incorporate the first case, the first element cover and the second element cover; fitting the first holder in the first annular groove and the second holder in the second annular groove; rotating the first and second rotary cylinders to place the first holder between the first rotary cylinder and the first case and the second holder between the second rotary cylinder and the first case and expose the first and second annular grooves, fitting the main holder in the exposed first and second annular grooves; and overlapping the second case with the first case.

According to the aforementioned configuration, the first and second rotary cylinders are inserted into the through holes formed in the outer wall of the housing. After incorporation of the first case, the first element cover and the second element cover, the first holder is fitted in the first annular groove. The second holder is fitted in the second annular groove. By rotation of the first and second rotary cylinders, the first holder is situated between the first rotary cylinder and the first case. The second holder is situated between the second rotary cylinder and the first case. Meanwhile, the first and second annular grooves are exposed. The main holder is fitted in the exposed first and second annular grooves. Consequently, the first and second element covers are easily fixed to the first case. The second case is then overlapped with the first case, so that the antenna device is completed. Consequently, the antenna device is easily assembled.

In the aforementioned configuration, the step of overlapping the second case with the first case may include: placing the second case so that an outer surface opposite to the attachment surface faces the first case; making the first antenna element, which extends from the processor, intersect with the second antenna element and inserting the first antenna element into the first protruding cylinder via the first rotary cylinder and the second antenna element extending from the processor into the second protruding cylinder via the second rotary cylinder; reversing the second case so that an intersection between the first and second antenna elements disappears; and overlapping the second case with the first case.

According to the aforementioned configuration, in the step of overlapping the second case with the first case, the second case is placed so that the outer surface opposite to the attachment surface faces the first case. The first antenna element extending from the processor intersects with the second antenna element, and is inserted into the first protruding cylinder via the first rotary cylinder. The second antenna element extending from the processor is inserted into the second protruding cylinder via the second rotary cylinder. The second case is then reversed so that the intersection between the first and second antenna elements disappears. Thereafter, the second case is overlapped with the first case. The first and second antenna elements are easily inserted into the first and second element covers. Therefore, the antenna device is easily assembled.

INDUSTRIAL APPLICABILITY

The principles of the aforementioned embodiment are suitably applied to devices configured to operate under communication of radio waves.

The invention claimed is:

1. An antenna device comprising:

a first antenna element and a second antenna element which transmit and receive a radio wave;

a housing which stores a processor configured to process a signal in response to the radio wave;

a first element cover configured to store the first antenna element; and a second element cover configured to store the second antenna element, wherein the first element cover includes a first rotary cylinder, which is held by the housing and rotatable around a first rotational axis, and a first protruding cylinder, which protrudes from the first rotary cylinder and encloses the first antenna element, the first rotary cylinder protruding from the housing along the first rotational axis, the second element cover includes a second rotary cylinder, which is held by the housing and rotatable around a second rotational axis, and a second protruding cylinder, which protrudes from the second rotary cylinder and encloses the second antenna element, the second rotary cylinder protruding from the housing along the second rotational axis, and a first included angle defined between the first protruding cylinder and the second protruding cylinder is changed by rotation of at least one of the first and second rotary cylinders wherein the first rotary cylinder includes a first distal end which protrudes from a joint portion between the first rotary cylinder and the first protruding cylinder along the first rotational axis, and the second rotary cylinder includes a second distal end which protrudes from a joint portion between the second rotary cylinder and the second protruding cylinder along the second rotational axis.

2. The antenna device according to claim 1, wherein a first inclination angle of the first rotational axis with respect to a center line, which halves a second included angle between the first and second rotational axes, and a second inclination angle of the second rotational axis with respect to the center line range from 30° to 60°.

3. The antenna device according to claim 2, wherein the first and second inclination angles range from 40° to 50°.

4. The antenna device according to claim 2, wherein the first protruding cylinder protrudes from the first rotary cylinder at the first inclination angle, and the second protruding cylinder protrudes from the second rotary cylinder at the second inclination angle.

5. The antenna device according to claim 4, wherein the first and second protruding cylinders are on a reference surface defined by the first and second rotational axes and extend along the center line.

6. The antenna device according to claim 1, further comprising:

a first holder configured to hold the first rotary cylinder in the housing; and a second holder configured to hold the second rotary cylinder in the housing, wherein the first rotary cylinder has a first annular groove depressed so that the first holder fits in the first annular groove, the second rotary cylinder has a second annular groove depressed so that the second holder fits in the second annular groove, the housing includes an outer wall formed with through holes through which the first and second rotary cylinders extend, an outer diameter of the first rotary cylinder held by the outer wall is larger than an outer diameter of the first rotary cylinder defined by the first annular groove, and an outer diameter of the second rotary cylinder held by the outer wall is larger than an outer diameter of the second rotary cylinder defined by the second annular groove.

7. The antenna device according to claim 6, further comprising a main holder which is overlapped with the first and second holders and fitted in the first and second annular grooves, wherein the main holder holds the first and second rotary cylinders simultaneously.

8. The antenna device according to claim 7, wherein the housing includes a first case, which has the outer wall, and a second case, which is overlapped with the first case, and the second case includes an attachment surface to which the processor is attached.

9. The antenna device according to claim 1, wherein the housing, the first element cover and the second element cover are made of resin.

10. A manufacturing method for the antenna device according to claim 8, the method comprising steps of:

inserting the first and second rotary cylinders into the through holes to incorporate the first case, the first element cover and the second element cover;

fitting the first holder in the first annular groove and the second holder in the second annular groove;

rotating the first and second rotary cylinders to place the first holder between the first rotary cylinder and the first case and the second holder between the second rotary cylinder and the first case and expose the first and second annular grooves;

fitting the main holder in the exposed first and second annular grooves; and overlapping the second case with the first case.

11. The manufacturing method according to claim 10, wherein the step of overlapping the second case with the first case comprises:

placing the second case so that an outer surface opposite to the attachment surface faces the first case;

making the first antenna element, which extends from the processor, intersect with the second antenna element, and inserting the first antenna element into the first protruding cylinder through the first rotary cylinder and the second antenna element extending from the processor into the second protruding cylinder through the second rotary cylinder;

reversing the second case so that an intersection between the first and second antenna elements disappears; and overlapping the second case with the first case.

12. An antenna comprising:

a first antenna element and a second antenna element which transmit and receive a radio wave;

a housing which stores a processor configured to process a signal in response to the radio wave, wherein the housing includes a connector connected to an actuator which executes a predetermined operation in response to a processing signal output from the processor, and the connector is detachable from the actuator;

a first element cover configured to store the first antenna element; and a second element cover configured to store the second antenna element, wherein the first element cover includes a first rotary cylinder, which is held by the housing and rotatable around a first rotational axis, and a first protruding cylinder, which protrudes from the first rotary cylinder and encloses the first antenna element, the first rotary cylinder protruding from the housing along the first rotational axis, the second element cover includes a second rotary cylinder, which is held by the housing and rotatable around a second rotational axis, and a second protruding cylinder, which protrudes from the second rotary cylinder and encloses the second antenna element, the second rotary cylinder protruding from the housing along the second rotational axis, and a first included angle defined between the first protruding cylinder and the second protruding cylinder is changed by rotation of at least one of the first and second rotary cylinders.

* * * * *